US008851611B2

(12) United States Patent
Taniguchi

(10) Patent No.: US 8,851,611 B2
(45) Date of Patent: Oct. 7, 2014

(54) CORRECTION INFORMATION DETERMINATION METHOD AND RECORDING APPARATUS

(75) Inventor: Hisashi Taniguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 814 days.

(21) Appl. No.: 13/016,894

(22) Filed: Jan. 28, 2011

(65) Prior Publication Data

US 2011/0199415 A1 Aug. 18, 2011

(30) Foreign Application Priority Data

Feb. 15, 2010 (JP) ..... 2010-030454

(51) Int. Cl.

| | |
|---|---|
| ***B41J 29/38*** | (2006.01) |
| ***B41J 13/00*** | (2006.01) |
| ***B41J 29/02*** | (2006.01) |
| ***B41J 29/13*** | (2006.01) |
| ***B41J 29/393*** | (2006.01) |
| ***B41J 11/46*** | (2006.01) |

(52) U.S. Cl.

CPC ..... *B41J 29/02* (2013.01); *B41J 13/0009* (2013.01); *B41J 29/13* (2013.01); *B41J 29/393* (2013.01); *B41J 11/46* (2013.01); *B41J 29/38* (2013.01)

USPC ..... 347/16; 347/5

(58) Field of Classification Search

USPC ..... 347/16

See application file for complete search history.

(56) References Cited

U.S. PATENT DOCUMENTS

2008/0079766 A1 4/2008 Nakano
2008/0266348 A1* 10/2008 Seki et al. ..... 347/19

FOREIGN PATENT DOCUMENTS

JP 2008-87341 A 4/2008

* cited by examiner

*Primary Examiner* — Uyen Chau N Le
*Assistant Examiner* — Kajli Prince
(74) *Attorney, Agent, or Firm* — Canon USA, Inc., IP Division

(57) ABSTRACT

A correction information determination method may be used to control a recording apparatus. The recording apparatus includes a first conveyance unit, a second conveyance unit, and a recording unit arranged between the first and second conveyance units. The first conveyance unit is caused to rotate and record patterns for measuring a conveyance distance when a conveyance state changes from both the first and second conveyance units being utilized to the second conveyance unit being utilized. A conveyance start rotation phase of the first conveyance unit is acquired. Based on the conveyance distance measured based on the patterns, correction information about a rotation amount of the first conveyance unit is determined, the rotation amount used when the conveyance state is changed during recording by the recording apparatus.

18 Claims, 23 Drawing Sheets

| CORRECTION VALUE | | |
|---|---|---|
| PHASE | CONVEYANCE ROLLER REGION | DISCHARGE ROLLER REGION |
| S1 | SLF1 | SEJ1 |
| S2 | SLF2 | SEJ2 |
| S3 | SLF3 | SEJ3 |
| S4 | SLF4 | SEJ4 |
| S5 | SLF5 | SEJ5 |
| S6 | SLF6 | SEJ6 |
| S7 | SLF7 | SEJ7 |
| S8 | SLF8 | SEJ8 |
| TRANSFER PHASE | TRANSFER CORRECTION VALUE | |
| PSK | SK | |

| CORRECTION VALUE | | |
|---|---|---|
| PHASE | CONVEYANCE ROLLER REGION | DISCHARGE ROLLER REGION |
| S1 | SLF1 | SEJ1 |
| S2 | SLF2 | SEJ2 |
| S3 | SLF3 | SEJ3 |
| S4 | SLF4 | SEJ4 |
| S5 | SLF5 | SEJ5 |
| S6 | SLF6 | SEJ6 |
| S7 | SLF7 | SEJ7 |
| S8 | SLF8 | SEJ8 |
| TRANSFER PHASE | TRANSFER CORRECTION VALUE | |
| PSK | SK | |

CORRECTION INFORMATION DETERMINATION METHOD AND RECORDING APPARATUS

BACKGROUND OF THE INVENTION

1. Field of the Invention

The present invention relates to a recording paper conveyance method, and in particular, to a recording paper conveyance technique used for an ink jet recording apparatus.

2. Description of the Related Art

Conventionally, recording apparatuses such as printers, particularly, ink jet recording apparatuses, use a conveyance mechanism including paper conveyance rollers. More specifically, two rollers, that is, a main roller and a discharge roller, are used to convey a recording paper accurately. A major problem in increasing the accuracy of conveying a recording paper with these rollers involves paper feeding at the transfer point from the main roller to the discharge roller. While the paper feeding at this transfer point is affected by variation in the accuracy of steady feeding operations of the rollers, the paper feeding is also affected by other factors, such as a warp in a roller shaft and an unstable behavior of the rollers when the recording paper is released from the main roller. Generally, it is known that the conveyance accuracy is decreased through the above steady feeding operations.

In response to such decrease in the conveyance accuracy, Japanese Patent Application Laid-Open No. 2008-87341 discusses a recording apparatus. This recording apparatus forms predetermined correction value measurement test patterns and measures conveyance amount errors generated at the transfer point twice. By calculating an average of these measured values, the recording apparatus determines a correction value.

However, when the recording paper is transferred from the main roller to the discharge roller, variation in speed increasing ratio may be caused between the main roller and the discharge roller. When the recording apparatus discussed in Japanese Patent Application Laid-Open No. 2008-87341 calculates the correction value, such variation is also included. The variation in speed increasing ratio between the main roller and the discharge roller are caused to occur by the diameters of the rollers at the macro level and by the eccentricity of the rollers at the micro level. According to Japanese Patent Application Laid-Open No. 2008-87341, it is unclear where the measured conveyance amount errors exist in a variation distribution, and there is no guarantee that the average, that is, the correction value, is the center value of the entire variation distribution. Namely, the correction value is not reliable. Thus, a conveyance amount that does not correspond to the set correction value is generated with a certain probability, resulting in deterioration in image quality.

SUMMARY OF THE INVENTION

The present invention is directed to a recording apparatus capable of accurately causing the trailing edge of a recording medium to pass a conveyance roller located upstream of a recording head with reduced variation.

According to an aspect of the present invention, there is provided a correction information determination method for controlling a recording apparatus including a first conveyance unit configured to convey a recording medium in a conveyance direction, a recording unit arranged downstream of the first conveyance unit in the conveyance direction and configured to record an image on the recording medium, and a second conveyance unit arranged downstream of the recording unit in the conveyance direction and configured to rotate in synchronization with the first conveyance unit and to convey the recording medium. The method includes: via the recording apparatus, causing the first conveyance unit to rotate by a predetermined amount and recording patterns for measuring a conveyance distance when a conveyance state is changed from a state in which both the first and second conveyance units convey the recording medium to a state in which the second conveyance unit conveys the recording medium after a trailing edge of the recording medium passes the first conveyance unit and the first conveyance unit releases the recording medium; acquiring a conveyance start rotation phase of the first conveyance unit, the conveyance start rotation phase used when the conveyance state is changed by causing the first conveyance unit to rotate by the predetermined amount, to determine a conveyance start rotation phase of the first conveyance unit, the conveyance start rotation phase used when the conveyance state is changed during recording by the recording apparatus; and determining, based on the conveyance distance measured based on the patterns, correction information about a rotation amount of the first conveyance unit, the rotation amount used when the conveyance state is changed during recording by the recording apparatus.

According to an exemplary embodiment of the present invention, the trailing edge of the recording medium can accurately pass a conveyance roller located upstream of a recording head with reduced variation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
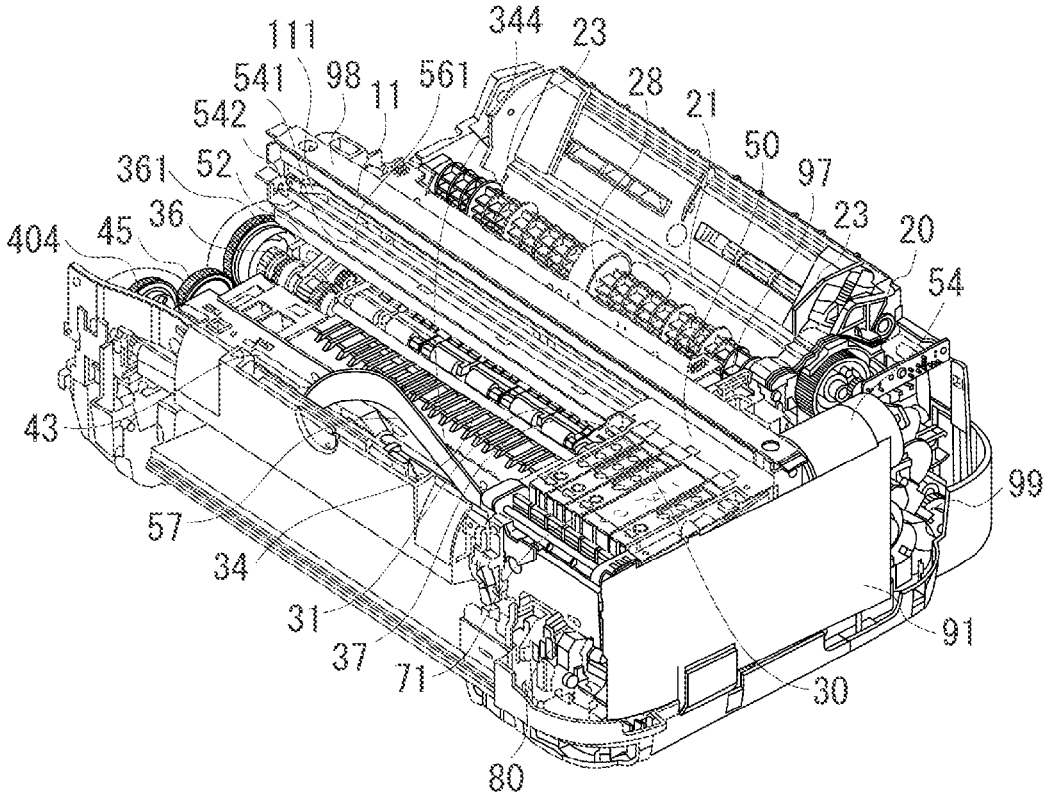
FIG. 1 is a perspective view of a mechanism portion of a recording apparatus according to a first exemplary embodiment of the present invention.
Figure 2:
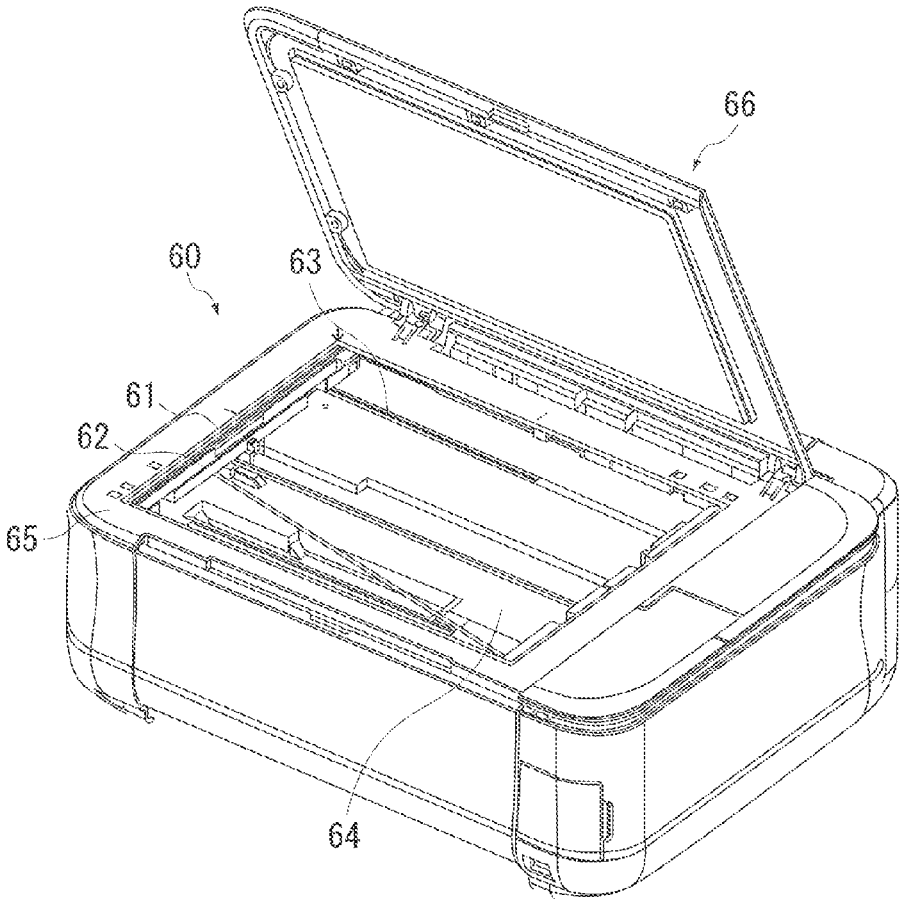
FIG. 2 is a perspective view of the entire recording apparatus according to the first exemplary embodiment of the present invention.

FIG. 1 is a perspective view of a mechanism portion of a recording apparatus according to a first exemplary embodiment of the present invention. FIG. 2 is a perspective view of the entire recording apparatus according to the first exemplary embodiment.

A paper feed unit includes a pressing plate 21 on which recording paper as a recording medium is mounted, a feed roller 28 feeding the recording paper, a separation roller (not illustrated) separating the recording paper, a return lever (not illustrated) returning the recording paper to a mounting position, and the like. The paper feed unit is attached to a paper feed unit base 20.

A paper feed tray (not illustrated) holding the mounted recording paper is attached to the paper feed unit base 20 or an exterior.

The feed roller 28 is rod-shaped and is circular in cross-section to feed recording paper. A motor 99 (hereinafter referred to as an AP motor or a sheet feeding motor) shared with a cleaning section 80 arranged in the paper feed unit transmits drive force to the feed roller 28 via a drive transmission gear, a planetary gear, and the like.

The pressing plate 21 is provided with movable side guides 23 so that the movable side guides 23 can move. The mounting position of the recording paper is defined by movement of the movable side guides 23. The pressing plate 21 is rotatable around a rotation shaft connected to the paper feed unit base 20. When paper is fed, a pressing plate spring (not illustrated) applies force to the feed roller 28.

In a paper feed operation, recording paper is sent to a nip portion including the feed roller 28 and the separation roller. This nip portion separates the recording paper to convey only a top recording paper.

A paper transfer unit is attached to a bent and raised sheet-metal chassis 11 and molded chassis 97 and 98. A conveyance roller 36 (first conveyance roller) has a metal shaft coated with ceramic micro-particles. A bearing receives metal parts of both shafts, and this bearing is attached to the molded chassis 97 and 98. A plurality of pinch rollers 37 (first pinch rollers) abuts against and drives with the conveyance roller 36. A pinch roller holder 30 holds these pinch rollers 37, and urging force of a pinch roller spring 31 firmly presses the pinch rollers 37 to the conveyance roller 36, producing force to convey the recording paper. A paper guide (not illustrated) guiding the recording paper is arranged at the entrance of the paper transfer unit to which the recording paper is conveyed. In addition, the pinch roller holder 30 is provided with a paper edge sensor (not illustrated) detecting the leading and trailing edges of the recording paper. A platen 34 is attached to the chassis 11 and positioned. Based on the above configuration, after a recording paper is sent to the paper transfer unit, the recording paper is guided by the pinch roller holder 30 and the paper guide (not illustrated). Next, the recording paper is sent to the conveyance roller 36 and the pinch rollers 37. The paper edge sensor (not illustrated) detects the leading edge of the recording paper to determine the print position of the recording paper. Further, a conveyance motor 35 rotates the rollers 36 and 37 to convey the recording paper on the platen 34.

In addition, the recording apparatus includes a recording head 7 downstream of the conveyance roller 36 in the conveyance direction. The recording head 7 forms an image based on image information. As the recording head 7, an ink jet recording head is used. The ink jet recording head includes ink tanks 71 of various colors, and each of the ink tanks can be changed separately. Ink of this recording head 7 can be heated by a heater or the like. With this heat, ink causes film boiling, and this film boiling causes bubble growth or contraction. Based on the generated pressure variations, the recording head 7 discharges ink from nozzles to form an image on the recording paper.

Additionally, the platen 34 facing ink discharge ports of the recording head 7 is supplied with a platen absorber 344 absorbing ink running off the end of the recording paper. When the recording apparatus executes borderless printing, the platen absorber 344 absorbs all the ink running off the four side ends of the recording paper.

A carriage section includes a carriage 50 to which the recording head 7 is attached. The carriage 50 is supported by a lower guide rail 52 for reciprocal scanning of the recording paper in a direction perpendicular to the conveyance direction and by an upper guide rail 111 holding an end of the carriage 50 and maintaining a gap between the recording head 7 and the recording paper. The lower guide rail 52 is attached to the chassis 11. The upper guide rail 111 is integrally formed with the chassis 11.

A carriage motor 54 attached to the chassis 11 drives the carriage 50 via a timing belt 541. The timing belt 541 is stretched and supported by an idle pulley 542. A code strip 561 having markings at a pitch of 150 to 300 lines per inch (lpi) for detecting the position of the carriage 50 is arranged in parallel to the timing belt 541. In addition, an encoder sensor (not illustrated) reading the markings is attached to a carriage substrate (not illustrated) mounted on the carriage 50. The carriage substrate includes a contact for establishing electrical connection with the recording head 7 and a flexible cable 57 for sending signals from an electric substrate 500 to the recording head 7. Based on the above configuration, when the recording apparatus forms an image on a recording paper, the rollers 36 and 37 arranged upstream of an image forming unit in the conveyance direction convey the recording paper, the carriage motor 54 moves the carriage 50 to scan the recording paper, and the recording head 7 discharges ink to the recording paper.

A sheet discharge unit includes a discharge roller 40 (second conveyance roller) and a rotatable spur (second pinch roller) (not illustrated) that abuts against the discharge roller 40 with a predetermined pressure. The spur is driven with the discharge roller 40.

The discharge roller 40 arranged downstream in the recording paper conveyance direction has a metal shaft on which a plurality of rubber parts is formed. Since an idler gear 45 transmits driving force from the conveyance roller 36 to a discharge roller gear 404 directly connected to the discharge roller 40, the discharge roller 40 is driven to rerate in synchronization with the conveyance roller 36. The spur 42 is attached to a spur holder 43. A coil spring is arranged in the form of a rod to form a spur spring (not illustrated), and the spur is firmly connected to the discharge roller 40 by the spur spring.

With the above configuration, the nip between the discharge roller 40 and the spur 42 sandwiches a recording paper on which image is formed. Subsequently, the discharge roller 40 and the spur 42 convey and discharge the recording paper.

The cleaning section 80 includes a pump (not illustrated) for cleaning the recording head 7, a cap (not illustrated) for preventing drying of the recording head 7, a blade (not illustrated) for cleaning the face of nozzles of the recording head 7, and the like.

The above AP motor 99 transmits most of the driving force of the cleaning section 80. When the cap is firmly attached to the recording head 7 and the pump is operated, the pump suctions unnecessary ink and the like from the recording head 7. When the cap is lowered, the blade moves in a direction perpendicular to the scanning direction of the carriage 50 to clean the face of the recording head 7.

The recording apparatus according to the present exemplary embodiment integrally includes a scanner unit 60 as an image reading apparatus above the recording unit.

The scanner unit 60 includes contact sensors 61 linearly arrayed to read an image, a scanner carriage 62 on which the contact sensors 61 are mounted to scan the recording paper, and a scanner guide shaft 63 guiding the scanner carriage 62. In addition, the scanner unit 60 includes a document positioning glass plate 64 on which a document is placed, a scanner base 65 housing these scanner-related components, a document cover 66 pressing a document placed on the document positioning glass plate 64, and the like.

The scanner carriage 62 on which the contact sensors 61 are mounted is supplied with driving force from a motor via a belt or the like to move along the scanner guide shaft 63 and to scan the recording paper. The transparent document positioning glass plate 64 is arranged on the scanner carriage 62, and the contact sensors 61 are pressed against the document positioning glass plate 64 from underneath with a predetermined pressure.

The document cover 66 can rotate about a fulcrum arranged in the scanner base 65 and can firmly press the document placed on the document positioning glass plate 64.

Figure 3:
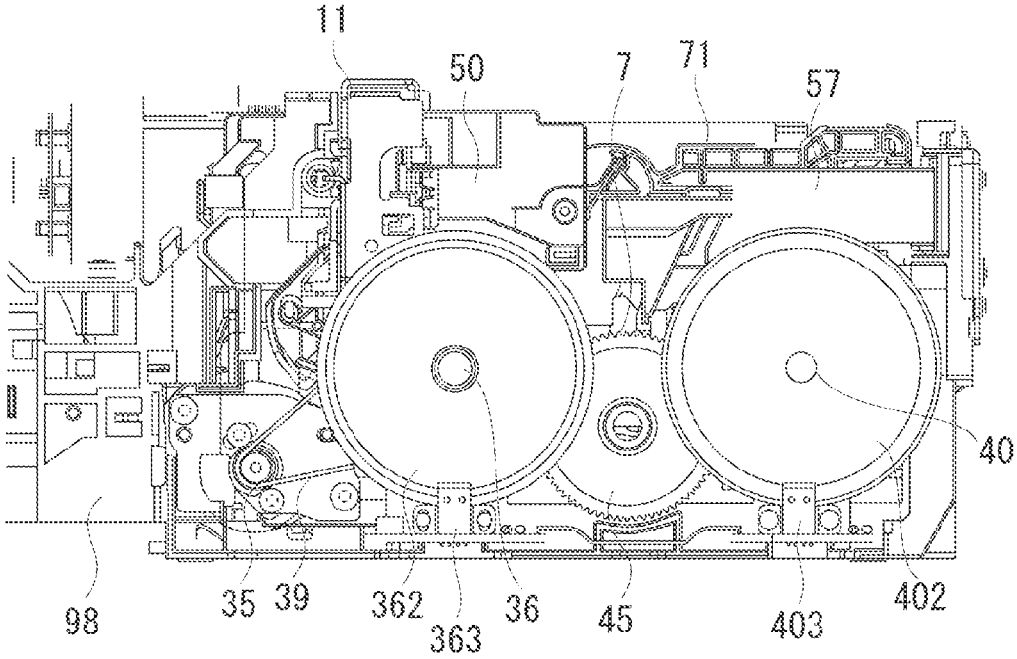
FIG. 3 is a side view of a conveyance drive system according to the first exemplary embodiment of the present invention.

Next, a conveyance drive system will be described in detail. As illustrated in FIG. 3, the conveyance motor 35 formed by a DC motor generates rotational force, and a timing belt 39 transmits the rotational force to a conveyance roller gear (pulley gear) 361 firmly fixed to the shaft of the conveyance roller 36. In this way, the conveyance motor 35 drives the conveyance roller 36. In addition, the shaft of the conveyance roller 36 is directly connected to a conveyance code wheel 362 having markings at a pitch of 150 to 360 lpi for detecting an angle of rotation of the conveyance roller 36. In addition, a conveyance roller encoder sensor 363 as a phase detection unit reading the markings is attached to the chassis 11. The conveyance roller encoder sensor 363 is located adjacent to the conveyance code wheel 362. The pulley gear 361 includes a pulley unit and a gear unit. The gear unit supplies driving force to the discharge roller gear 404 via the idler gear 45 to drive the discharge roller 40.

In addition, a discharge roller encoder 403 and a discharge code wheel 402 used as position detection units detecting an angle of rotation of the discharge roller 40 are arranged on the shaft of the discharge roller 40. The discharge code wheel 402 is not an essential element of the present invention. However, since the discharge code wheel 402 is effective in accurate transfer, the discharge code wheel 402 is included in FIG. 3. According to the present exemplary embodiment, the rotation ratio between the conveyance roller 36 and the discharge roller 40 is 1:1. In addition, the rotation ratio among the conveyance roller gear 361, the idler gear 45, and the discharge roller gear 404 used as units to transmit drive force to the conveyance roller 36 and the discharge roller 40 is 1:1. With this configuration, both of the conveyance roller 36 and the discharge roller 40 have the same rotation period. In addition, the transmission gears thereof have the same rotation period. Thus, conveyance misalignment caused by the rollers appears in a period identical to the rotation of the rollers.

According to the present exemplary embodiment, for simplicity, the rotation ratio between the transmission gears is set to 1:1. However, for example, the rotation ratio of the idler gear 45 or the discharge roller 40 may be an integral multiple of one rotation of the conveyance roller 36. Alternatively, the rotation ratio of the idler gear 45 or the discharge roller 40 may be one-nth (integral submultiple) of one rotation of the conveyance roller 36 (n=integer). In this way, the discharge roller 40 has a predetermined rotation period which is an integral multiple of the rotation period of the conveyance roller 36. For example, when the rotation ratio among the conveyance roller, the discharge roller, and the idler gear is 1:m:1/n, the conveyance roller has a rotation period of m×n. In this case, information about the number of rotations of the conveyance roller 36 can be detected based on rotation phase origin information about the idler gear 45 and the discharge roller 40.

Figure 4:
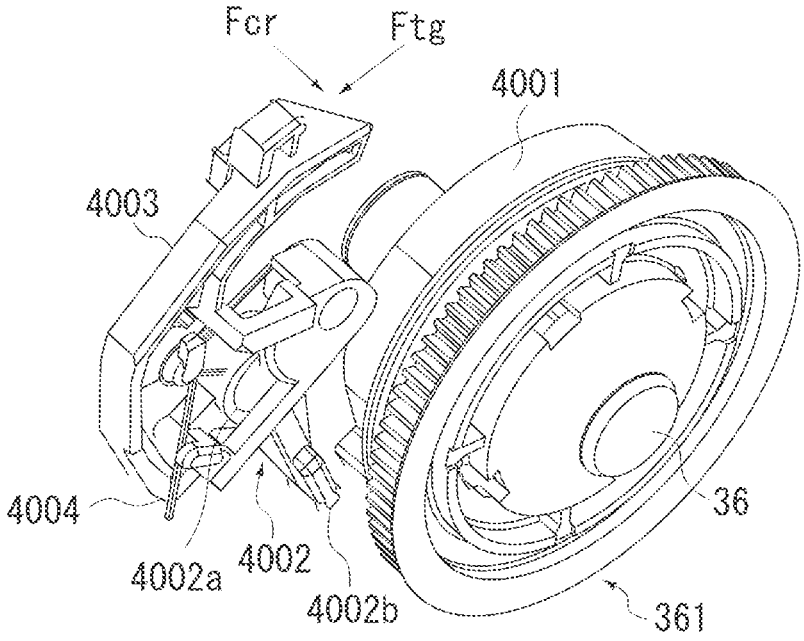
FIG. 4 is a perspective view of a locking mechanism unit according to the first exemplary embodiment of the present invention.
Figure 5:
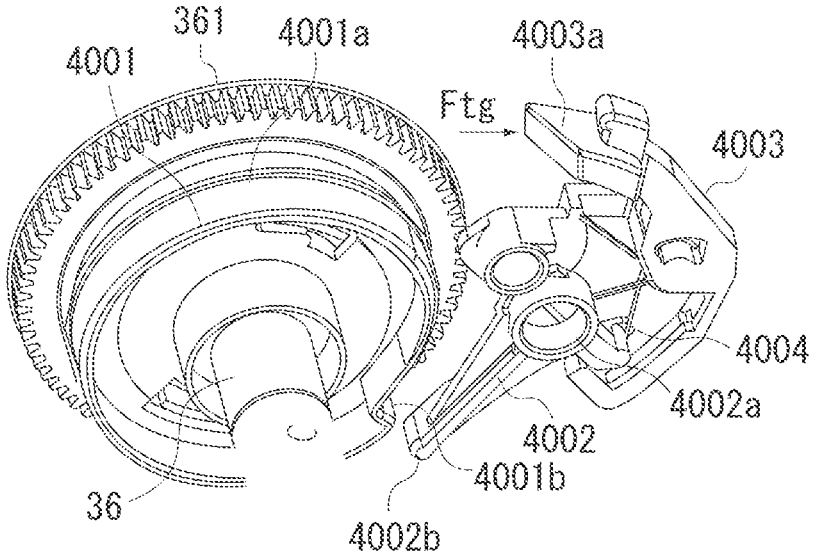
FIG. 5 is a perspective view of a locking mechanism unit according to the first exemplary embodiment of the present invention.

FIGS. 4 and 5 illustrate a mechanism for detecting a roller rotation phase origin. A lock ring 4001 is a locked member attached to the conveyance roller gear 361 and includes a circumference portion 4001*a* and a recessed portion 4001*b*. A lock lever 4002 for locking rotation of the locked member includes a rotation center 4002*a* and a lock portion 4002*b* for locking the lock ring 4001. A lock ring lever 4003 pushes and pulls the lock lever 4002. A lock lever spring 4004 generates force to push the lock lever 4002 and to pull the lock ring lever 4003.

Figure 6:
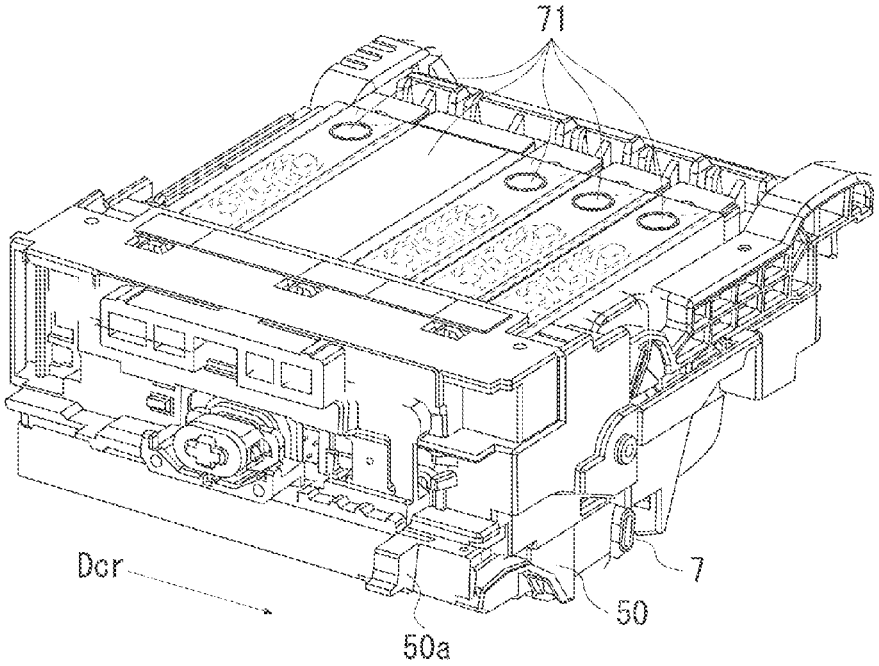
FIG. 6 is a perspective view of a carriage trigger unit according to the first exemplary embodiment of the present invention.

A protruding portion 50*a* of the carriage 50 illustrated in FIG. 6 generates force Ftg for moving the lock ring lever 4003. When the carriage 50 executes a scanning operation in a direction Dcr, the carriage 50 abuts against and pushes a slope surface 4003*a* of the lock ring lever 4003 with force Fcr. In this way, the force Ftg is generated. This abutment position is arranged outside the region where the carriage 50 executes a scanning operation during recording on the recording paper.

The abutment position is a scanning position arranged only for locking the conveyance roller 36.

Figure 7A:
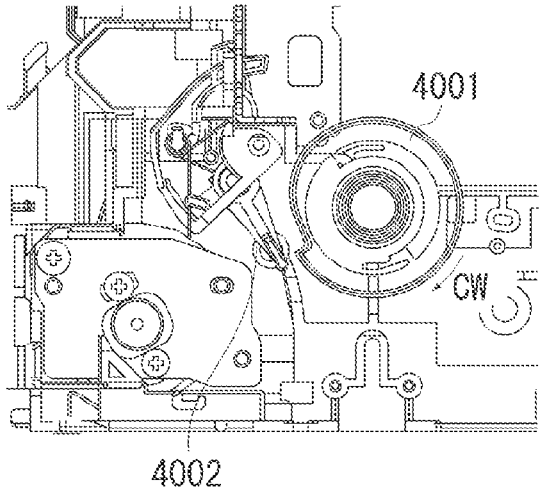
FIGS. 7A to 7C illustrate a lock operation according to the first exemplary embodiment of the present invention.
Figure 7B:
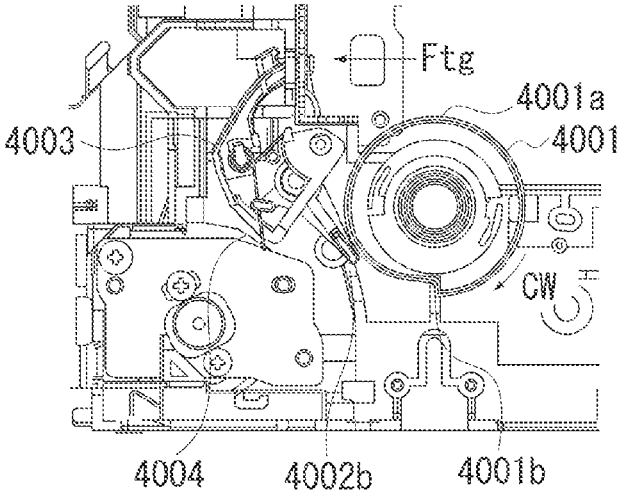
Figure 7C:
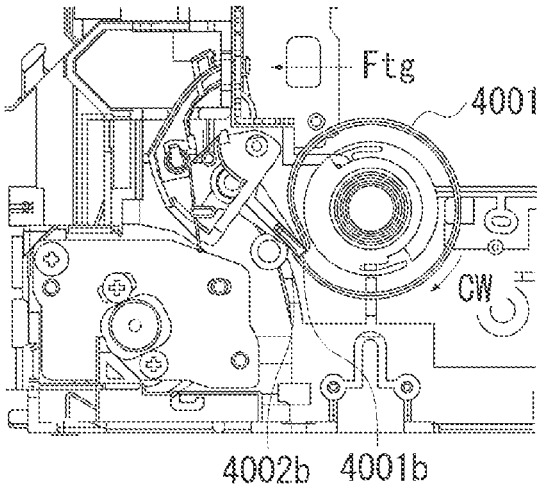

FIG. 7A illustrates a normal printing state in which the lock ring 4001 and the lock lever 4002 are separated and a roller origin detection function is disabled. During printing, the conveyance roller 36 is rotated in a direction CW to convey the recording paper. When the lock ring 4001 and the lock lever 4002 receive a mechanical trigger for detecting the roller origin, as illustrated in FIG. 7B, the lock portion 4002*b* abuts against the lock ring circumference portion 4001*a*. However, the lock ring 4001 and the lock lever 4002 illustrated in FIG. 7B are still in an unlocked state. From this state, if the conveyance roller 36 is rotated in the direction CW, after a predetermined rotation, the lock ring recessed portion 4001*b* engages with the lock portion 4002*b*. As a result, the rotation of the lock ring 4001 is prevented. Namely, the rotation is locked as illustrated in FIG. 7C.

The conveyance roller 36 is locked only at a predetermined phase of a single rotation. Thus, by storing this predetermined phase at which the conveyance roller 36 is locked as a count value of the conveyance roller encoder sensor 363, the absolute position of the conveyance roller 36 can be detected.

The above configuration for detecting the phase origin is not a feature of the present invention. A sensor may detect a one period/one rotation edge printed on a known code wheel. Alternatively, a photo interrupter may be used so that a sensor may detect a one period/one rotation edge attached to a roller or the like.

Figure 8:
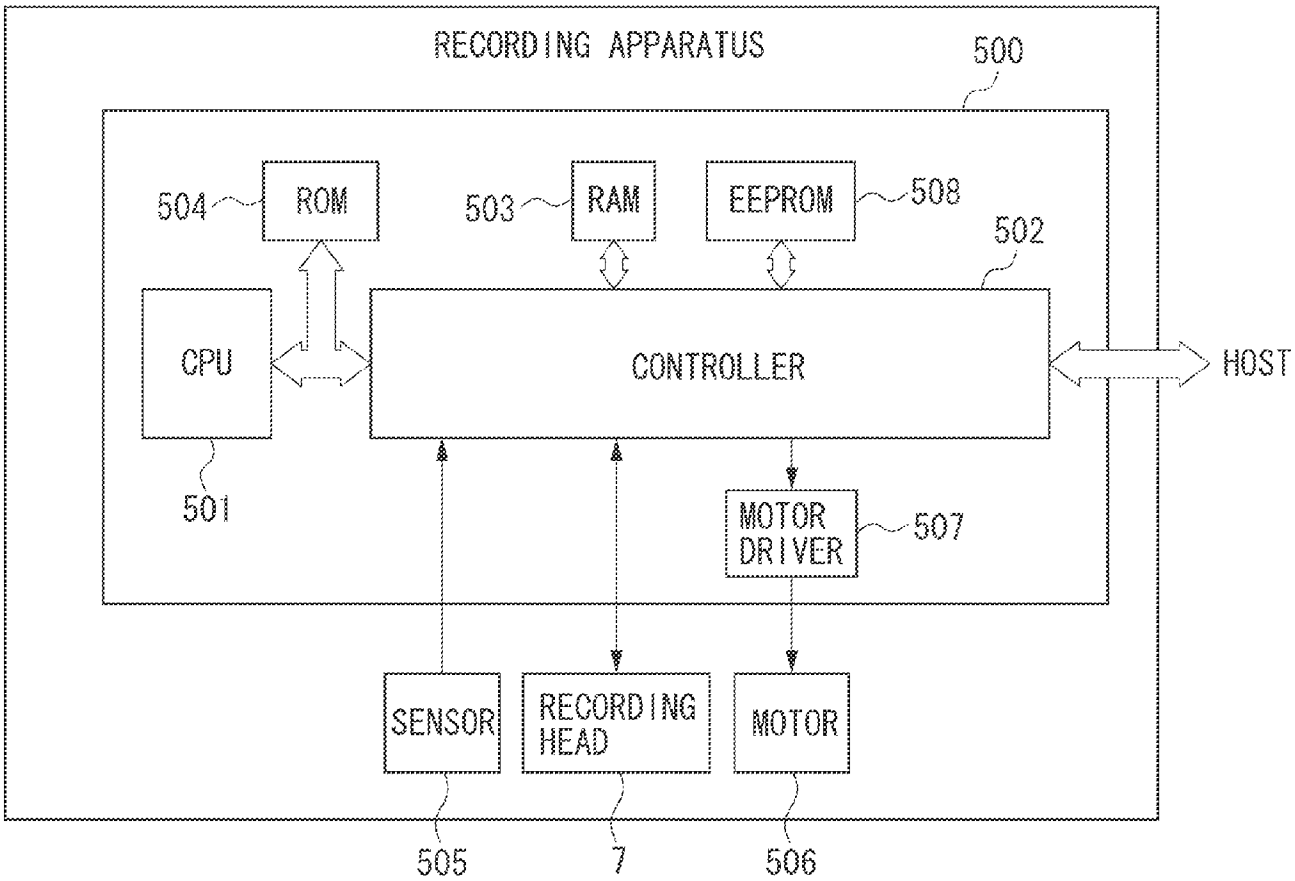
FIG. 8 is an electrical block diagram according to the first exemplary embodiment of the present invention.

FIG. 8 illustrates an electrical block diagram of the recording apparatus. As illustrated in FIG. 8, the recording apparatus includes a central processing unit (CPU) 501 controlling the recording apparatus and a random access memory (RAM) 503 storing rasterization data to be printed, data received from a host, and the like. The recording apparatus further includes a motor 506 representing a plurality of motors and a motor driver 507 representing a plurality of motor drivers and driving the motor 506. The recording apparatus further includes a controller 502 controlling: access to the RAM 503; exchange of data with the host; exchange of control signals with a sensor 505 such as the conveyance roller encoder sensor 363 and the recording head 7; and transmission of control signals to the motor driver 507. The recording apparatus further includes an electrically erasable/programmable read only memory (EEPROM) 508, which is a nonvolatile ROM. The EEPROM 508 stores values set at factories and data to be updated, and the controller 502 and the CPU 501 use the data as control parameter values, for example. The CPU 501 executes mechanical and electrical control on the recording apparatus based on control programs stored in the ROM 504. While the host sends information such as emulation commands to the recording apparatus, the CPU 501 reads this information via an input/output (I/O) data register in the controller 502. In addition, the CPU 501 executes control corresponding to each command via the I/O data register in the controller 502 or an I/O port, thereby controlling printing. The RAM 503 has a ring buffer unit and executes increment processing on encoder count information. In addition, the RAM 503 or EEPROM 508 stores information about the origin phase of the conveyance roller. The rotation phase of the conveyance roller 36 is managed based on the detected locked state position. Since the encoder count values of a single rotation of the conveyance roller 36 are known and fixed, the roller phase can be managed based on information about the rotation amount or position.

Since the conveyance roller 36 and the discharge roller 40 originally have conveyance distance errors, a conveyance accuracy calibration or the like is executed prior to factory shipment or on the user side. Through this calibration, the conveyance accuracy in a section where both the conveyance roller 36 and the discharge roller 40 convey a recording paper and the conveyance accuracy in a section where the discharge roller 40 alone conveys a recording paper are acquired in advance. By storing the results in the EEPROM 508 as correction information, correction values with respect to the conveyance distance errors attributable to the diameter or eccentricity of the conveyance roller 36 can be set. Thus, the conveyance distance can be complemented.

Manufacturing misalignment in eccentricity or circularity is present between the conveyance roller 36 and the discharge roller 40. Thus, during a single rotation of a roller, variations in conveyance speed are caused between the conveyance roller 36 and the discharge roller 40. Namely, since paper transfer from the conveyance roller 36 to the discharge roller 40 involves a conveyance state where both the conveyance roller 36 and the discharge roller 40 convey a recording paper and a conveyance state where the discharge roller 40 alone conveys the recording paper, change of the conveyance state during paper transfer results in a rapid change in conveyance speed. This change in conveyance speed often causes a roller and the recording paper to slide on each other, resulting in conveyance errors. Also, this change in conveyance speed causes a warp in a roller to be eliminated, resulting in movement and shift of the recording paper. As a result, image quality is deteriorated.

Figure 9A:
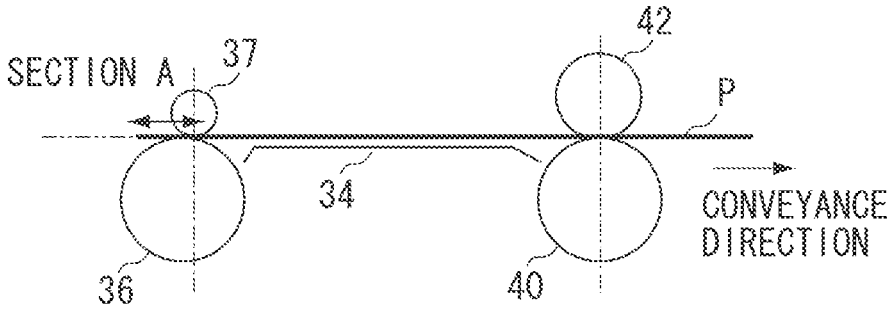
FIGS. 9A to 9C illustrate roller transfer according to the first exemplary embodiment of the present invention.
Figure 9B:
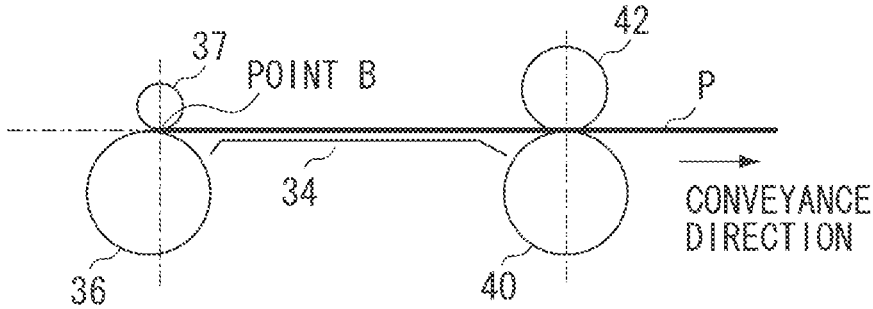
Figure 9C:
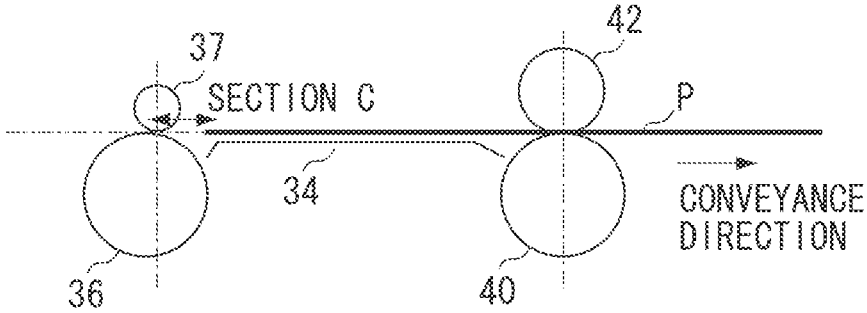

The conveyance distance made by the transfer from the conveyance roller 36 to the discharge roller 40, more specifically, the paper conveyance distance error caused when a roller and the recording paper slide on each other and the misalignment of the recording paper caused by elimination of the roll warp will be described with reference to FIGS. 9A to 9C. Regarding the transfer from the conveyance roller 36 to the discharge roller 40, a nip portion illustrated in FIG. 9B between the conveyance roller 36 and the pinch roller 37 is unstable to stop the recording paper. Thus, the conveyance needs to be controlled so that the recording paper does not stop at this nip portion. Namely, to cause the trailing edge of the recording paper to pass the nip of the conveyance roller 36, the recording paper trailing edge illustrated in FIG. 9A first needs to be located upstream of the nip between the conveyance roller 36 and the pinch roller 37, and the conveyance needs to be started from the position. The recording paper trailing edge travels a section A, which is from the initial position to the nip, and passes a point B, which is a unique part of the nip portion. Next, after passing the nip, the paper trailing edge travels a section C illustrated in FIG. 9C. In the section A, both the conveyance roller 36 and the discharge roller 40 convey the recording paper, and in the section C, the discharge roller 40 alone conveys the recording paper. If a unit conveyance amount (conveyance speed) differs between the above sections A and C, the total conveyance distance changes depending on the difference in conveyance speed and the section lengths. Regarding the conveyance distance during this transfer, it is necessary to consider conveyance speed variations attributable to the difference in unit conveyance amount (conveyance speed) between the rollers 36 and 40. Depending on the difference in roller conveyance speed, pulling force or repulsive force is generated between the conveyance roller 36 and the discharge roller 40 via the recording paper. Since the discharge roller 40 has a rigidity lower than that of the conveyance roller 36, the above force causes a warp in the discharge roller 40. When the trailing edge of the recording paper passes the point B, the force is released, and as a result, the warp in the discharge roller 40 is eliminated. In addition to rotation of the rollers, this elimination of the warp in the discharge roller 40 moves the recording paper and specifically changes the recording paper conveyance distance.

Figure 10:
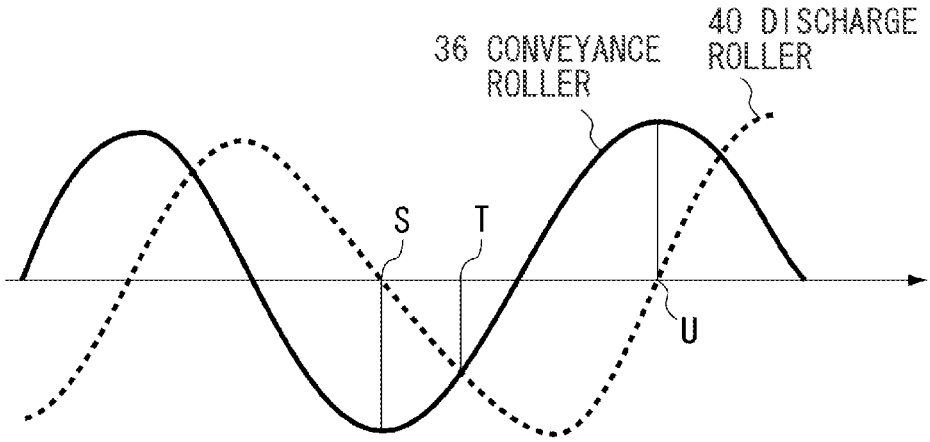
FIG. 10 illustrates the local feeding amount of each roller according to the first exemplary embodiment of the present invention.

When a recording paper is transferred from the conveyance roller 36 to the discharge roller 40, the difference in conveyance speed between the rollers 36 and 40 affects the conveyance distance of the recording paper. The impact caused thereby will be described with reference to FIG. 10, FIGS. 11A to 11C, and FIGS. 12A to 12C. In FIG. 10, the vertical axis represents conveyance speed error and the horizontal axis represents rotation phase (time). The solid and dashed lines represent variations in conveyance speed when the conveyance roller 36 and the discharge roller 40 convey the recording paper, respectively. Strictly, the above solid line represents the variations in conveyance speed when both the conveyance roller 36 and the discharge roller 40 convey the recording paper. However, hereinafter, for simplicity, the variations represented by the solid line are used to describe the conveyance error of the conveyance roller 36.

FIGS. 11A to 11C and FIGS. 12A to 12C illustrate conveyance speed variations attributable to rotation phases of the conveyance roller 36 and the discharge roller 40.

Figure 11A:
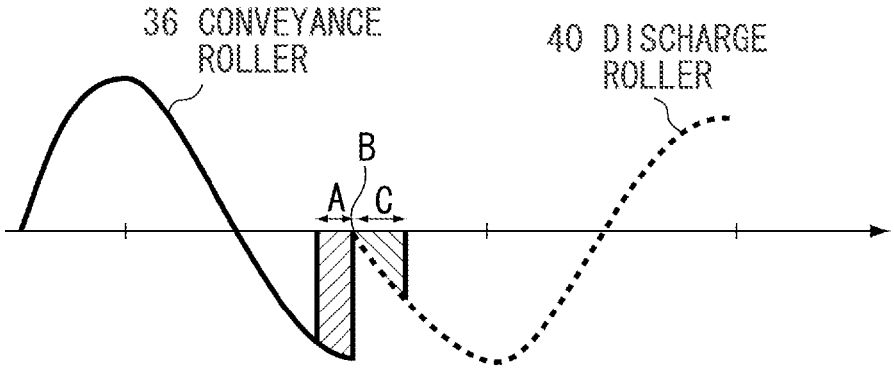
FIGS. 11A to 11C illustrate the impact of the local feeding amount of each roller according to the first exemplary embodiment of the present invention.
Figure 12A:
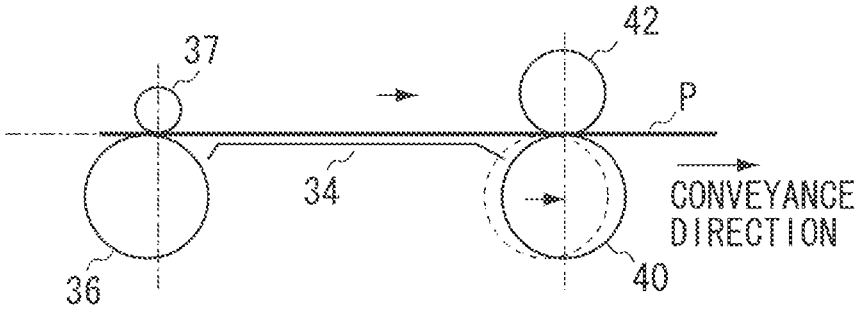
FIGS. 12A to 12C illustrate the behavior of a discharge roller according to the first exemplary embodiment of the present invention.

FIG. 11A illustrates the roller transfer at a phase S in FIG. 10. Since the conveyance speed of the discharge roller 40 is greater than that of the conveyance roller 36 at this phase S, the discharge roller 40 is the increased speed system. As illustrated in FIG. 12A, the discharge roller 40 is moved to the upstream side by the traction force (frictional force) between the discharge roller 40 and the recording paper. As soon as the trailing edge of the recording paper passes the nip of the conveyance roller 36, the warp in the discharge roller 40 is eliminated, and the discharge roller 40 is moved to the downstream side. Along with the movement of the discharge roller 40, the recording paper is moved and the conveyance distance is increased. By adding this conveyance distance to the conveyance distance of the conveyance section A by the conveyance roller 36 in FIG. 11A and the conveyance distance of the conveyance section C by the discharge roller 40 in FIG. 11A, the conveyance distance during the roller transfer can be calculated.

Figure 11B:
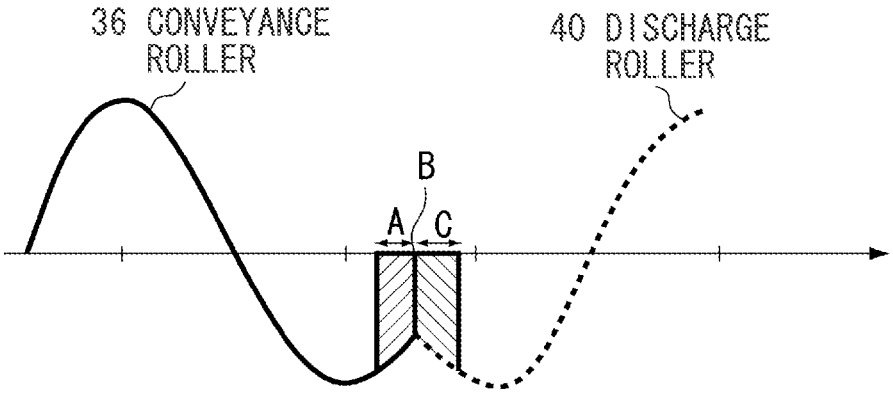
Figure 12B:
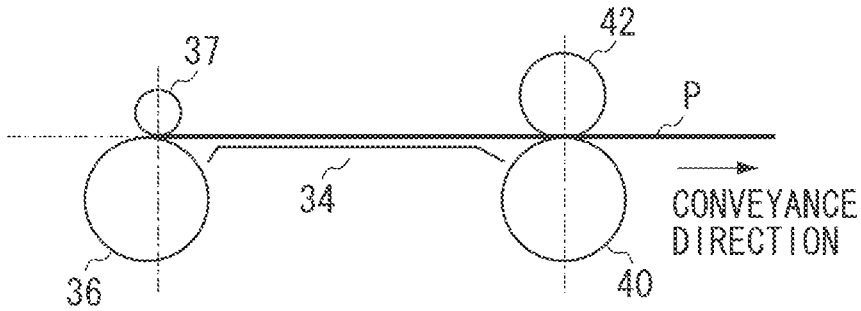

FIG. 11B illustrates the roller transfer at a phase T in FIG. 10. At this phase T, the conveyance roller 36 and the discharge roller 40 have the same conveyance speed. Thus, the discharge roller 40 is the equal speed system. As illustrated in FIG. 12B, since no force is exchanged between the discharge roller 40 and the conveyance roller 36, even after the trailing edge of the recording paper passes the nip of the conveyance roller 36, elimination of the warp in the discharge roller 40 is not caused. Namely, the conveyance distance is not changed by elimination of the warp in the discharge roller 40. By adding the conveyance distance of the conveyance section A by the conveyance roller 36 in FIG. 11B to the conveyance distance of the conveyance section C by the discharge roller 40 in FIG. 11B, the conveyance distance during the roller transfer can be calculated.

Figure 11C:
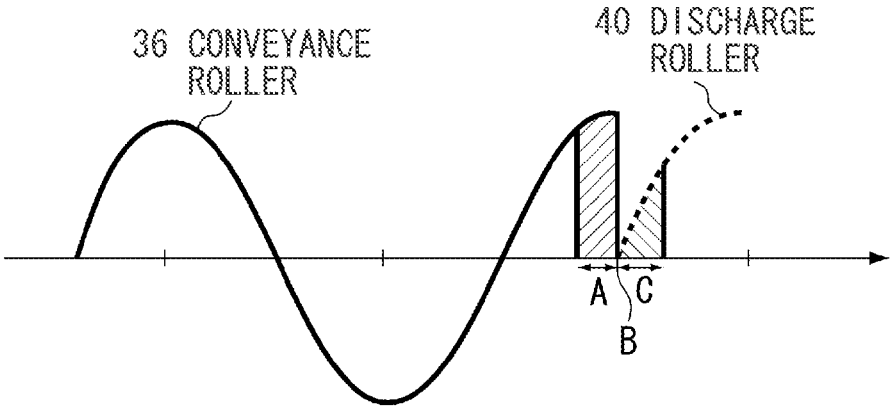
Figure 12C:
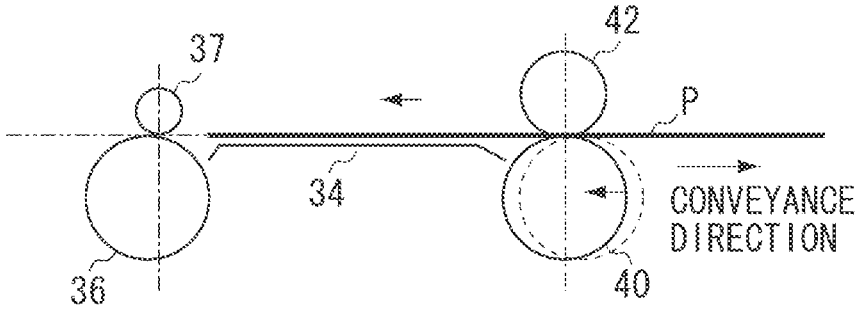

FIG. 11C illustrates the roller conveyance at a phase U in FIG. 10. At this phase U, since the conveyance speed of the conveyance roller 36 is greater than that of the discharge roller 40, the discharge roller 40 is the decreased speed system. As illustrated in FIG. 12C, while the discharge roller 40 has been moved to the downstream side by the traction force (frictional force) between the discharge roller 40 and the recording paper, as soon as the trailing edge of the recording paper passes the nip of the conveyance roller 36 and the warp is eliminated, the discharge roller 40 is moved to the upstream side. Accordingly, the conveyance distance of the recording paper is decreased. Thus, by adding this conveyance distance to the conveyance distance of the conveyance section A by the conveyance roller 36 in FIG. 11C and the conveyance distance of the conveyance section C by the discharge roller 40 in FIG. 11C, the conveyance distance during the roller transfer can be calculated.

As described above, the conveyance distance traveled by the recording paper when the recording paper passes the conveyance roller 36 is the sum of the conveyance distance of the conveyance section A by the conveyance roller 36, the conveyance distance of the conveyance section C by the discharge roller 40, and the distance that the recording paper is moved by elimination of the warp in the discharge roller 40. Thus, by fixing the phase of each of the rollers when the trailing edge of the recording paper passes the conveyance roller 36 at a predetermined phase, the conveyance distance traveled by the recording paper when the recording paper passes the conveyance roller 36 can be stabilized.

Figure 13:
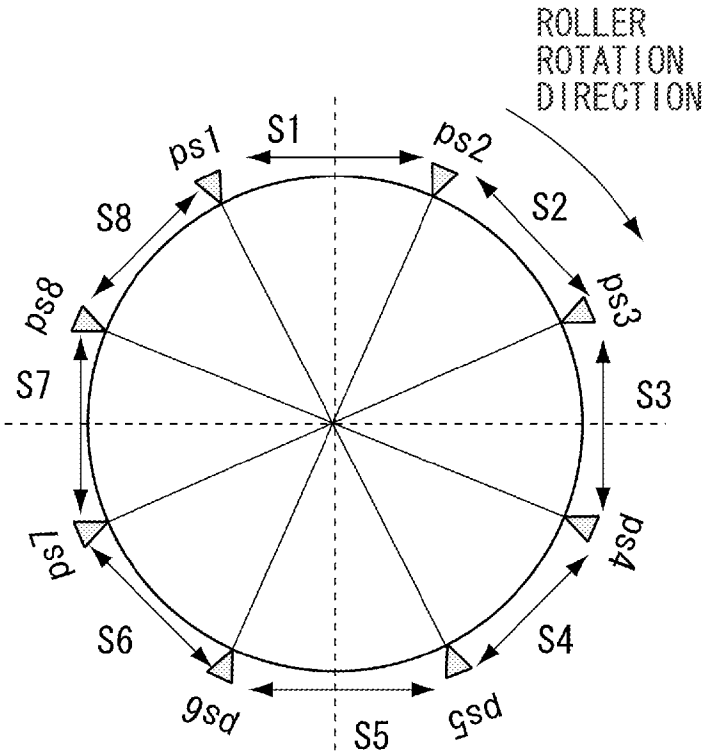
FIG. 13 illustrates a schematic correction configuration according to the first exemplary embodiment of the present invention.
Figure 14:
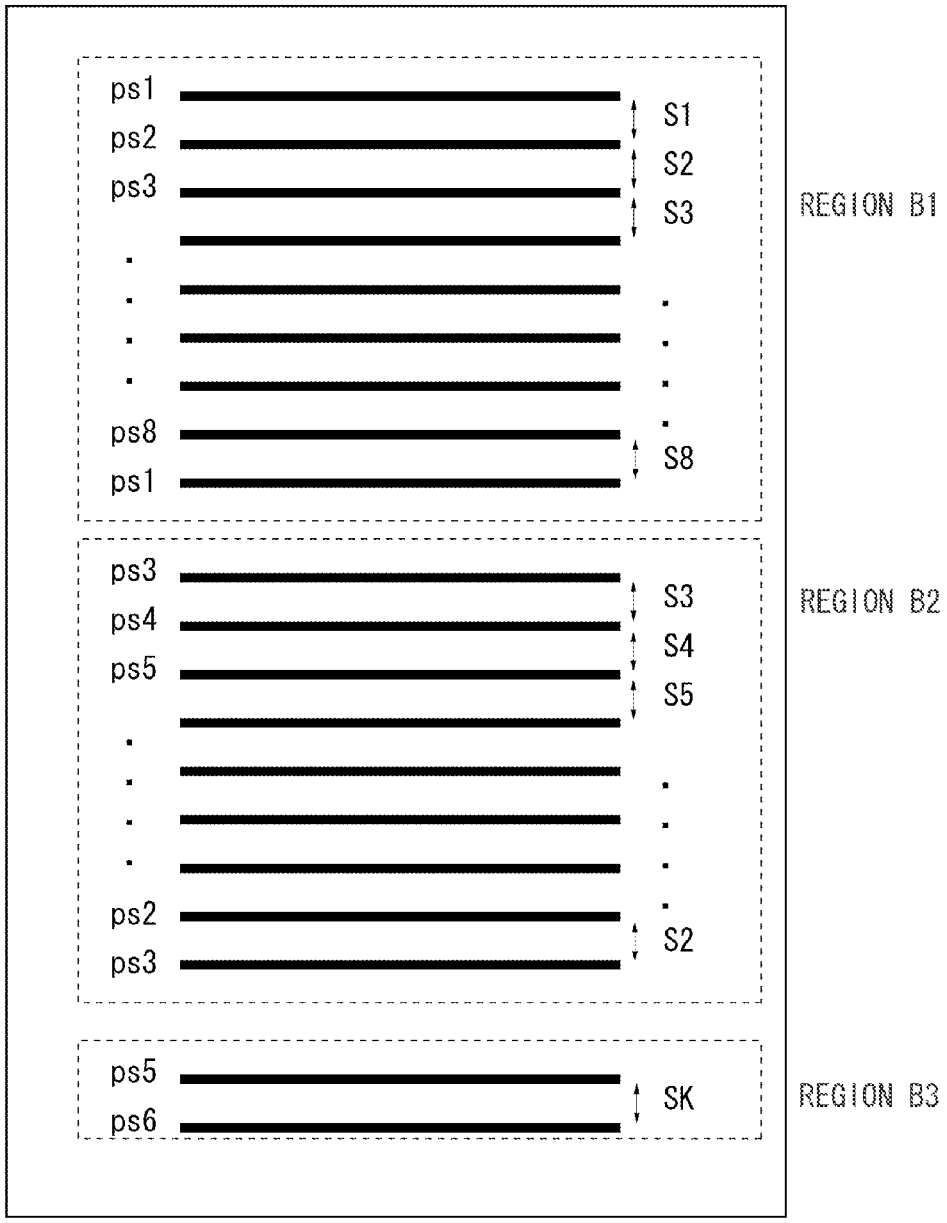
FIG. 14 illustrates correction value measurement test patterns according to the first exemplary embodiment of the present invention.

Next, a method for determining conveyance distance correction values used during the transfer from the conveyance roller 36 and the discharge roller 40 will be described. FIG. 13 illustrates a conceptual diagram of a roller and a table of correction values. In FIG. 13, the rotation phase of the roller is divided into eight sections for simplicity, and a correction value is set per roller phase section and is stored in the table. Based on the correction value table according to the present exemplary embodiment, since the rotation phase ratio between the conveyance roller 36 and the discharge roller 40 is the same, each of the phases of the rollers is represented by a single angle. FIG. 14 illustrates correction value measurement test patterns. The recording apparatus prints these test patterns to calculate a unit conveyance distance for each roller phase section.

The correction value measurement test patterns in FIG. 14 include a pattern region B1 for measuring a unit conveyance distance per phase section of the conveyance roller 36 and a pattern region B2 for measuring a unit conveyance distance per phase section of the discharge roller 40. In addition, the test patterns in FIG. 14 include a pattern region B3 for measuring the conveyance distance traveled by the recording paper during the transfer from the conveyance roller 36 to the discharge roller 40.

Figure 15A:
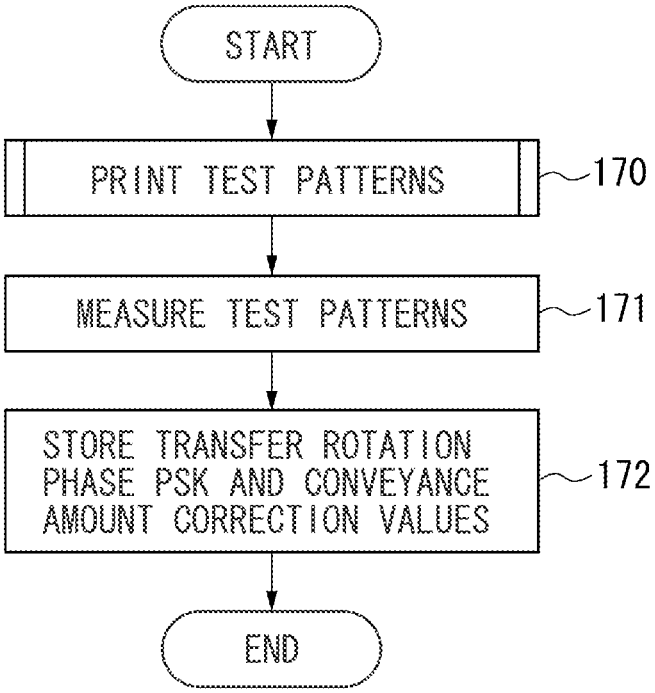
FIGS. 15A and 15B are control flow charts according to the first exemplary embodiment of the present invention.
Figure 15B:
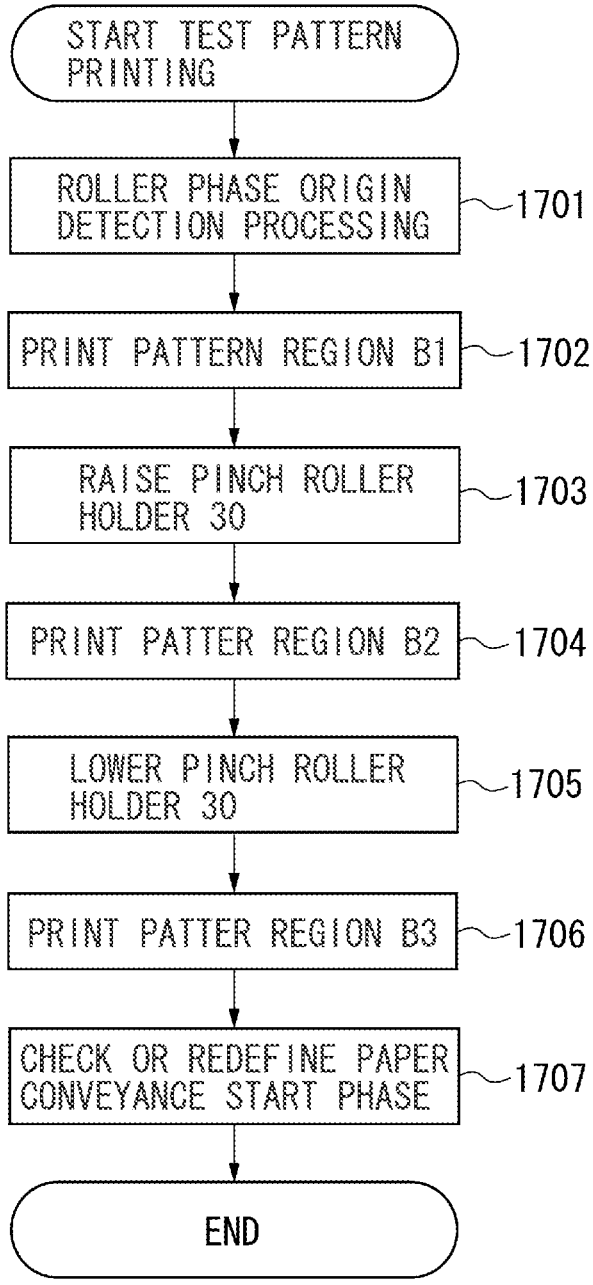

FIGS. 15A and 15B are flow charts illustrating a specific conveyance distance correction value determination method.

First, in step 170, the recording apparatus prints test patterns. Before printing the test patterns, first, in step 1701, the recording apparatus executes the above roller phase origin detection processing. Namely, in step 1701, the mechanical roller phase origin is determined so that the phases can be managed.

Next, in step 1702, the recording apparatus prints the test patterns illustrated in FIG. 14. More specifically, to print the test patterns in the pattern region B1, first, the recording apparatus executes a paper feed operation, and next, the conveyance roller 36 conveys the recording paper until the rotation phase thereof reaches a pattern print start position ps1. When the rotation phase reaches the position ps1, the recording apparatus controls the conveyance roller 36 to stop the conveyance and controls the recording head 7 to print the first row of the test patterns. Next, the recording apparatus causes the conveyance roller 36 to rotate with a predetermined amount and convey the recording paper accordingly, until the rotation phase of the conveyance roller 36 reaches a position ps2. When the rotation phase of the conveyance roller 36 reaches the position ps2, the recording apparatus stops the conveyance roller 36. When the conveyance roller 36 stops the recording paper, the recording apparatus controls the recording head 7 to print the second row of the test patterns.

This operation is repeated until the rotation phase of the conveyance roller 36 reaches the position ps1 again (in the present exemplary embodiment, nine test patterns are printed by repetition of the above operation).

Before printing the test patterns in the pattern region B2 to measure a unit conveyance distance of the discharge roller 40, in step 1703, the recording apparatus eliminates the conveyance force of the conveyance roller 36. More specifically, the recording apparatus controls a lift-up cam (not illustrated) to raise the pinch roller holder 30. In this way, firm connection between the conveyance roller 36 and the pinch roller 37 is canceled.

In step 1704, when the phase of the discharge roller 40 reaches a position ps3, the recording apparatus controls the discharge roller 40 to stop the conveyance and controls the recording head 7 to print the first row of the test patterns. Next, the recording apparatus rotates the discharge roller 40 with a predetermined amount to convey the recording paper, until the phase of the discharge roller 40 reaches a position ps4. When the phase reaches the position ps4, the recording apparatus stops the discharge roller 40 and controls the recording head 7 to print the second row of the test patterns. The operation is repeated until the phase of the discharge roller 40 reaches the position ps3 again (needless to say, nine test patterns are also printed by repetition of this operation in this region B2). Based on these operations, the conveyance distance of the recording paper when a roller is rotated from a predetermined point on the roller circumference by a predetermined angle (when a roller is rotated until the conveyance roller encoder sensor 363 reads a predetermined number of markings on the code wheel 362) can be represented as the interval between patterns.

Next, in step 1705, to print the pattern region B3, the recording apparatus rotates the lift-up cam (not illustrated) and firmly attaches the pinch roller 37 to the conveyance roller 36 again.

Next, in step 1706, the recording apparatus prints the test patterns in the pattern region B3 to measure the conveyance distance traveled when the trailing edge of the recording paper passes the nip between the conveyance roller 36 and the pinch roller 37. In the present exemplary embodiment, because of the layout of the test patterns and the paper size, when the trailing edge of the recording paper passes the nip between the conveyance roller 36 and the pinch roller 37, the phase of the discharge roller 40 is basically changed from the position ps5 to the position ps6. The recording paper is conveyed until the phase ps5 is reached. The paper edge sensor (not illustrated) detects the trailing edge of the recording paper, and the recording apparatus stops the conveyance when the recording paper reaches a point a predetermined amount short of the nip between the conveyance roller 36 and the pinch roller 37. Namely, the recording apparatus stops the conveyance when the recording paper reaches a point a predetermined amount short of the point of transfer from the conveyance roller 36 to the discharge roller 40. In the present exemplary embodiment, the recording apparatus stops the trailing edge of the recording paper $^{64}/_{1200}$ inches short of the nip position between the conveyance roller 36 and the pinch roller 37. Since this phase at which the recording paper stops is managed by the controller 502, whether the phase actually reaches the position ps5 can be checked. If the phase does not reach the position ps5, in step 1707, the phase actually checked is redefined as a paper conveyance start phase, to start recording of the test patterns of the pattern region B3 for measuring the conveyance distance traveled when the trailing edge of the recording paper passes the nip between the conveyance roller 36 and the pinch roller 37. The present exemplary embodiment will be described based on the assumption that the paper conveyance start phase is the position ps5.

When the phase of the conveyance roller 36 and the discharge roller 40 corresponds to the position ps5, the recording apparatus stops the conveyance and controls the recording head 7 to print the first row of the test patterns. Next, the recording apparatus conveys the recording paper $^{160}/_{1200}$ inches, which is defined as the roller conveyance distance according to the present exemplary embodiment. This conveyance distance is equal to the conveyance distance of the trailing edge of the recording paper when the recording paper passes the nip between the conveyance roller 36 and the pinch roller 37 during an actual recording operation. The recording apparatus rotates the conveyance roller 36 by a predetermined amount (a predetermined angle) to execute this conveyance. Based on this conveyance operation, the trailing edge of the recording paper on which the test patterns have actually been printed is released from the conveyance roller 36 and is subsequently conveyed by the discharge roller 40 alone. After stopping the discharge roller 40, the recording apparatus controls the recording head 7 to print the second row of the test patterns. Based on these operations, the conveyance roller 36 and the discharge roller 40 are rotated from a predetermined rotation phase by a predetermined amount necessary for the transfer, and the conveyance distance of the recording paper can be represented as the interval between the patterns.

According to the present exemplary embodiment, printing of the test patterns is started at the phase ps1. However, in reality, printing of the test patterns may be started at an arbitrary phase. This is because, since the roller phase can be determined by the above origin detection processing, the test patterns and the test pattern print start phase can be associated on one-on-one level. In addition, according to the present exemplary embodiment, the pattern division number in printing the test patterns is the same as the roller phase management division number. However, for example, the pattern division number may be set greater than the management division number. In this way, accuracy in measurement is increased. Alternatively, the pattern division number may be set less than the management division number. In this way, measurement time can be shortened. As described above, if the pattern division number is different from the management division number, correction values need to be appropriately calculated by interpolation of measured values.

After the printing of the test patterns, in step 171, test pattern intervals S1 to S8 and SK are measured by a distance measurement unit or the like of an image processing system. In the present exemplary embodiment, the recording apparatus controls the scanner unit 60 therein as the distance measurement unit. The recording paper on which the test patterns have been printed is set at a predetermined position on the document positioning glass plate 64. The scanner carriage 62 executes a scanning operation along the scanner guide shaft 63, and the contact sensors 61 read the test pattern image. The CPU 501 or the like calculates the test pattern intervals S1 to S8 and SK, based on the read test pattern image.

Next, in step 172, the recording apparatus stores correction values in conveyance amount correction value storage locations prepared for the roller phases and the roller transfer.

More specifically, the measured values are subtracted from ideal roller conveyance distance values to obtain conveyance distance correction values. These calculated values are stored in SLF1 to SLF8, SEJ1 to SEJ8, and SK of the correction value table of FIG. 13. In addition, based on the paper conveyance start phase (ps5 in the above description) of the test pattern region B3, a predetermined phase (S5 in the above description) is stored in a roller transfer phase PSK.

Next, the recording apparatus determines correction information. The recording apparatus analyzes the read test pattern image data to calculate the conveyance distance actually measured based on the test pattern intervals S1 to S8. For example, assuming that the interval between the pattern recorded at the rotation phase ps1 and the pattern recorded at the rotation phase ps2 in the pattern region B1 is LLF1, this interval LLF1 is a measured value of the conveyance distance when the conveyance roller 36 is rotated from the phase ps1 to the phase ps2. Further, a theoretical conveyance distance calculated based on a roller diameter Dr is represented by π·Dr/8. The recording apparatus subtracts the measured value from the theoretical value to obtain the value SLF1 as correction information and stores the correction information in a nonvolatile storage unit. Namely, the value SLF1 can be calculated as follows:

$$SLF1=\pi\cdot Dr/8-LLF1$$

The recording apparatus calculates the correction values SLF2 to SLF8 and SEJ1 to SEJ8 in other phase sections in the above way and stores the correction values as correction information in the storage unit.

For example, assuming that the interval between the pattern recorded at the rotation phase ps1 and the pattern recorded at the rotation phase ps2 in the pattern region B2 is LEJ1, the collection value SEJ1 can be calculated as follows:

$$SEJ1=\pi\cdot Dr/8-LEJ1$$

Namely, even if the recording apparatus drives the conveyance roller 36 by a predetermined pulse amount of an encoder signal to cause the recording paper to travel the conveyance distance π·Dr/8, the recording paper actually stops, leaving the distance corresponding to the correction value SLF1 before traveling the conveyance distance π·Dr/8. Thus, by adding the correction value SLF1 to the target conveyance distance π·Dr/8 and driving the conveyance roller 36 based on the obtained distance, the recording paper can travel the target conveyance distance π·Dr/8.

When the trailing edge of the recording paper passes the nip between the conveyance roller 36 and the pinch roller 37, the recording paper is moved by the conveyance by both the conveyance roller 36 and the discharge roller 40, the conveyance by the discharge roller 40 alone, and the movement by elimination of the warp in the discharge roller 40. In addition, by obtaining the paper size and calculating the integrated values of the cumulative recording paper conveyance distances based on measured pattern data, the conveyance distance that the recording paper travels until the trailing edge thereof passes the nip can be calculated.

Assuming that the conveyance roller 36 starts conveying the recording paper at the phase between the phases ps7 and ps8, the distance between the leading edge of the recording paper and the first pattern recorded at the phase ps1 can be calculated. Further, assuming that the measured conveyance distance between the phases ps7 and ps8 is LLF7 and that the measured conveyance distance between the phases ps8 and ps1 is LLF8 in the pattern analysis of the region B1, the distance between the leading edge of the recording paper and the first pattern ps1 can be calculated as follows:

$$LLF7/2+LLF8$$

By adding, to this value, the measured conveyance distance between the first pattern at the phase ps1 and the pattern at the phase ps5 in the region B3, the distance between the leading edge of the recording paper and the pattern at the phase ps5 in the region B3 can be calculated. In addition, the conveyance distance between when the recording paper is started to be conveyed at the phase ps5 and when the recording paper passes the nip can be calculated. By calculating the conveyance distance from when the trailing edge of the recording paper is detected and by using the obtained distance, the conveyance distance that the recording paper travels until the trailing edge thereof passes the nip may be calculated.

Assuming that the recording paper travels a distance L51 by both the conveyance roller 36 and the discharge roller 40 and that the recording paper travels a distance L52 by the discharge roller 40 alone after passing the nip, if the recording paper conveyance distance measured from the test pattern SK portion is LS and the recording paper is moved by elimination of the warp in the discharge roller 40 by SK5, the distance LS can be calculated as follows:

$$LS=L51+L52+SK5$$

Next, the distances L52 and SK5 are calculated.

Assuming that the recording paper travels the distance L51 by both the conveyance roller 36 and the discharge roller 40 based on m51 pulses of the encoder signal and that the recording paper travels the distance L52 by the discharge roller 40 alone based on m52 pulses of the encoder signal, if the measured distance and the number of drive pulses between the patterns recorded at the phases ps5 and ps6 in the region B1 are LLF5 and m5, respectively, the conveyance distance per pulse lLF5 in the phase section S5 where the recording paper is conveyed by both the conveyance roller 36 and the discharge roller 40 can be represented as follows:

$$ILF5=LLF5/m5$$

The value m51 can be calculated based on ILF5 as follows:

$$m51=L51/ILF5$$

Since m51+m52 is a known value, m52 can also be calculated.

Assuming that the measured distance and the drive pulse number between the patterns ps5 and ps6 in the region B2 are LEJ5 and m5, respectively, the conveyance distance per pulse IEJ5 in the phase section S5 where the recording paper is conveyed by the discharge roller 40 alone can be calculated as follows:

$$IEJ5=LEJ5/m5$$

Thus, the distance L52 can also be calculated.

$$L52=IEJ5\times m52$$

Since the distances L51 and L52 have been calculated, the movement distance SK5 can also be calculated.

$$SK5=LS-L51-L52$$

The obtained value SK5 (error information) is stored in the storage unit as a correction value SKE.

In addition, regarding an ideal conveyance distance SK that the recording paper travels for measuring the test patterns in the region B3, if the trailing edge of the recording paper passes the conveyance roller 36 in an actual recording operation and the ideal conveyance distance SK is obtained, the above correction value calculation process may be simplified. As described above, assuming that the recording paper conveyance distance measured from the test pattern SK portion is LS and that the recording paper is moved by elimination of the warp in the discharge roller 40 by SK5, the distance LS can be calculated as follows:

$$LS=L51+L52+SK5$$

In all the recording operations, when the trailing edge of the recording paper passes the conveyance roller 36, since the conveyance start phase is fixed at PSK, the distances L51 and L52 are fixed values. The recording paper movement amount SK5 caused by elimination of the warp in the discharge roller 40 is also a fixed value. Thus, the distance LS calculated as follows is a fixed value.

$$LS=L51+L52+SK5=\text{a fixed value}$$

Based on the test patterns, the correction value SKE is calculated by subtracting the measured value LS from the ideal roller conveyance distance SK. Thus, the correction value SKE can be calculated as follows:

$$SKE=SK-LS$$

While application of these correction values in a recording operation will be described below, by adding the correction value SKE to a target conveyance distance LSK, the recording paper can travel the distance LSK.

Thus, the recording apparatus executes the operations as described above to determine the conveyance distance correction values and the roller transfer phase for the transfer from the conveyance roller 36 to the discharge roller 40.

In addition, regarding the above correction value measurement test patterns, the pattern regions B1 and B2 for measuring a unit conveyance amount for each phase of the conveyance roller 36 and the discharge roller 40, respectively, and the pattern region B3 for measuring the conveyance amount at the transfer from the conveyance roller 36 to the discharge roller 40 are recorded on a single piece of recording paper. However, depending on the recording paper size and the total conveyance distance per rotation (or the roller outer diameter) of the conveyance roller 36 and the discharge roller 40, the three pattern regions may not be recorded on a single piece of recording paper. In such case, the pattern regions may be appropriately divided and recorded on a plurality of pieces of recording paper.

Next, a method for controlling correction of the conveyance distance with use of the correction values calculated by recording of the above test patterns will be described. The method is used in a recording operation.

First, a method for controlling the roller transfer at a predetermined roller transfer phase will be described. After the recording paper is fed, when the leading edge of the recording paper is pinched by the nip of the conveyance roller 36, the recording paper and the phase of the conveyance roller 36 are uniquely determined. Thereafter, since the conveyance roller 36 conveys the recording paper with little sliding, the transfer point (phase) from the conveyance roller 36 to the discharge roller 40 can easily be calculated. Namely, by taking the recording paper length into consideration in advance and by adjusting the roller phase at which the leading edge of the fed recording paper is pinched by the nip of the conveyance roller 36, the phase at the roller transfer point B can be controlled.

Figure 16A:
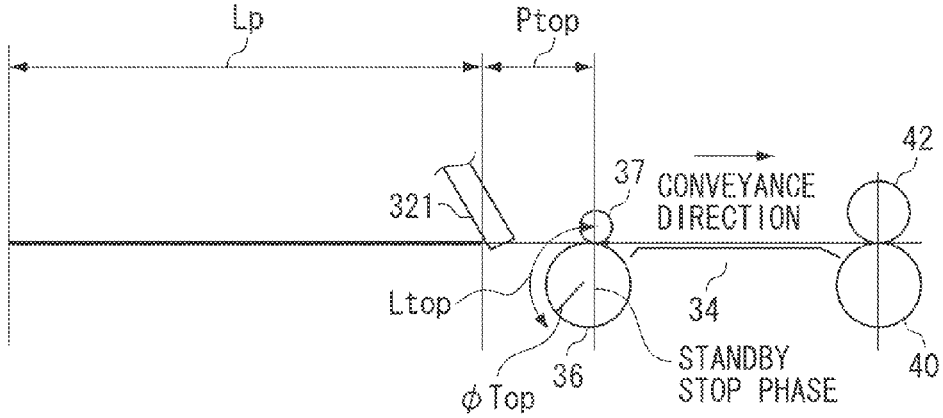
FIGS. 16A and 16B illustrate conveyance phases according to the first exemplary embodiment of the present invention.
Figure 16B:
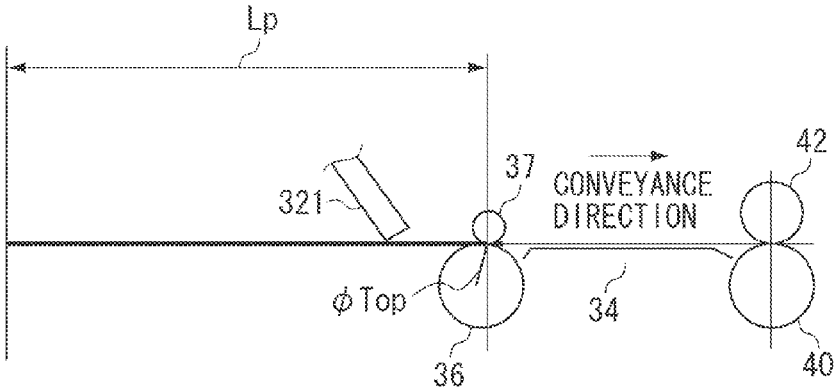
Figure 17:
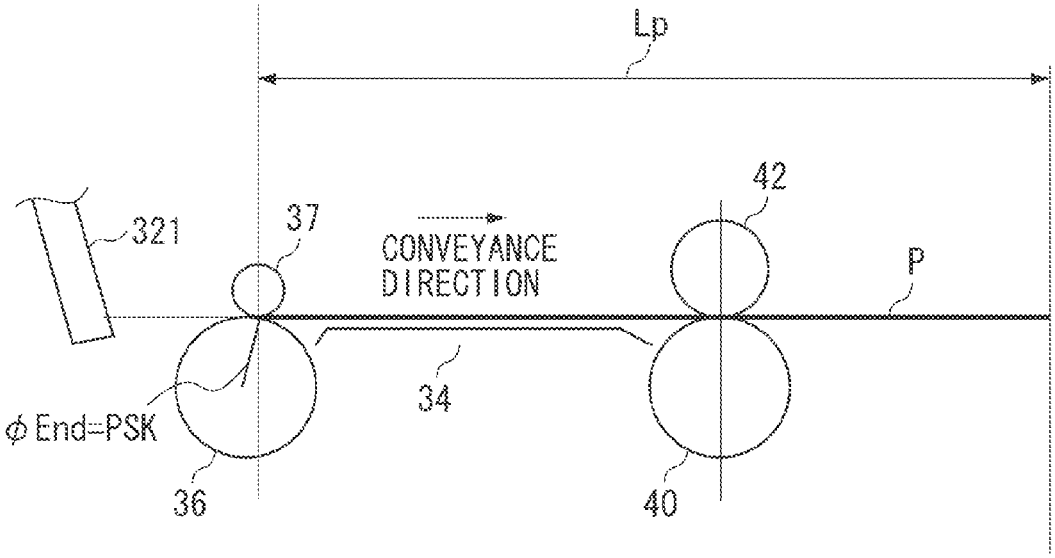
FIG. 17 illustrates a conveyance phase according to the first exemplary embodiment of the present invention.
Figure 18:
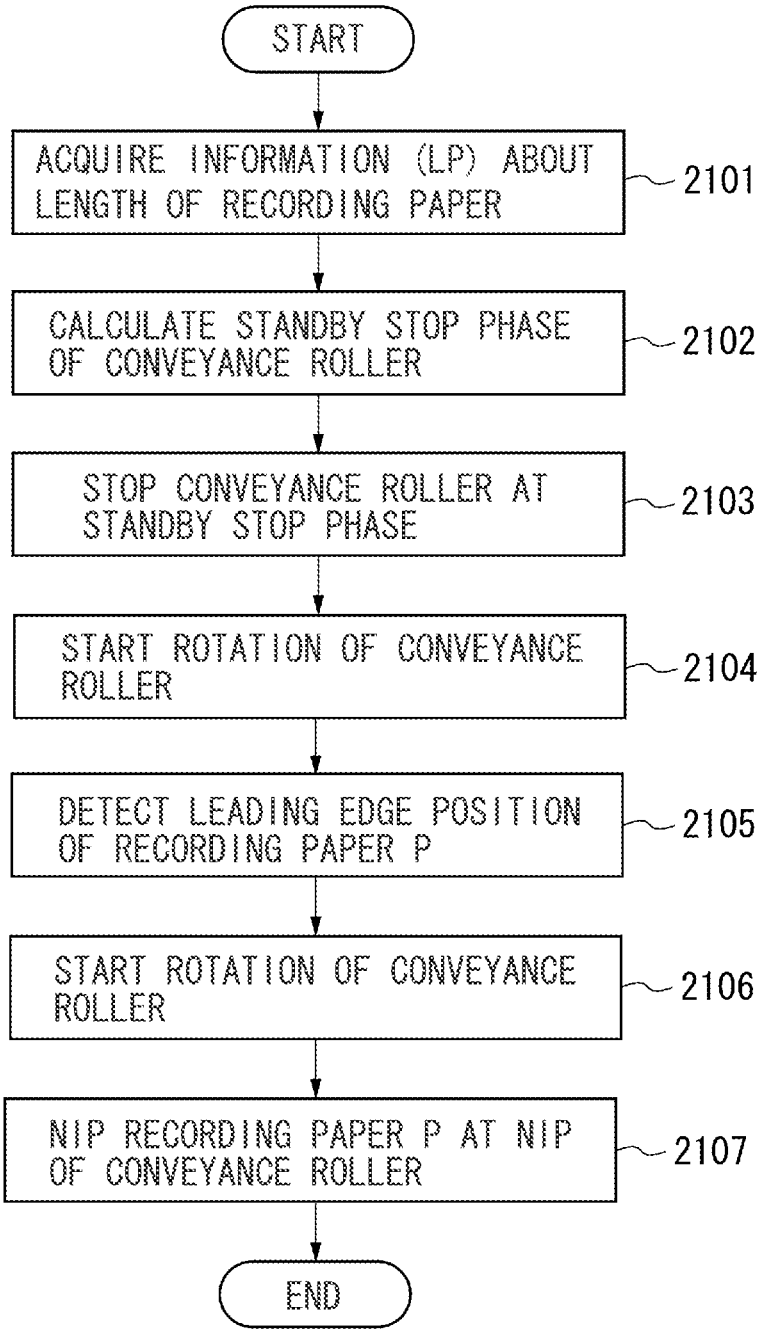
FIG. 18 is a control flowchart according to the first exemplary embodiment of the present invention.

FIGS. 16A, 16B, and 17 illustrate the above operation and FIG. 18 is a control flow chart of the above operation (printing without registration is used in the present exemplary embodiment). First, in step 2101, the recording apparatus acquires recording paper length information Lp from a printer driver or an input device. In this example, the recording apparatus acquires the information from the outside of the printer main body, a sensor or the like in the printer main body may detect the information. Next, in step 2102, to cause the conveyance roller 36 to stop and prepare for further conveyance, based on the acquired recording paper length information Lp, the recording apparatus calculates an initial phase (standby stop phase) corresponding to the information Lp. A method for calculating this standby stop phase will be described after the description of the flow chart. Next, in step 2103, the recording apparatus stops the conveyance roller 36 at the standby stop phase. Next, in step 2104, the recording apparatus rotates the feeding roller 28 to start feeding the recording paper. The recording paper fed by the feeding roller 28 abuts against and rotates a recording paper detection lever 321. Next, in step 2105, a recording paper leading edge position detection sensor detects a leading edge position Ptop of the recording paper. If the feeding roller 28 causes the recording paper to travel the distance Ptop from this detection point, the recording paper reaches the nip of the conveyance roller 36. In step 2106, from this point, the recording apparatus starts rotation of the conveyance roller 36. Until the recording paper reaches the nip of the conveyance roller 36, the recording apparatus rotates and drives the conveyance roller 36 at a speed in synchronization with the conveyance speed of the feeding roller 28. In step 2107, the nip portion of the conveyance roller 36 nips the recording paper. Since the printing without registration is used in the present exemplary embodiment, the roller transfer phase is determined at this point.

While the feeding roller 28 conveys the conveyance amount Ptop from the point where the leading edge of the recording paper is detected to the point where the leading edge is nipped by the nip of the conveyance roller 36, the conveyance roller 36 conveys a conveyance amount Ltop smaller than the conveyance amount Ptop. This is because the conveyance roller 36 starts its rotation from a stopped state, unlike the feeding roller 28 already in operation. When the rotation speed of the feeding roller 28 and the conveyance roller 36 is determined by a print mode, the conveyance amount Ltop can be calculated uniquely. Namely, the recording apparatus stops the conveyance roller 36 at the phase the conveyance amount Ltop short of the phase where the nip of the conveyance roller 36 nips the recording paper.

After the recording paper is nipped by the conveyance roller 36 and is conveyed by rotation of the conveyance roller 36 by the recording paper length Lp, the roller transfer from the conveyance roller 36 to the discharge roller 40 is executed (FIG. 17). The phase of the conveyance roller 36 is controlled in advance, so that the phase of the conveyance roller 36 at this transfer point reaches a predetermined phase. Namely, assuming that the set roller transfer phase of the conveyance roller 36 is PSK, in order to transfer the recording paper from the conveyance roller 36 to the discharge roller 40 at the phase PSK of the conveyance roller 36, the conveyance roller 36 needs to nip the recording paper at the phase a phase difference $(Lp)/(\pi Dr)$ short of the phase PSK (Dr is the diameter of the conveyance roller 36). In addition, the phase a phase difference $(Lp+Ltop)/(\pi Dr)$ short of the phase PSK can be set (calculated) as the standby stop phase of the conveyance roller 36. Strictly, a roller sliding amount needs to be considered. However, in the present exemplary embodiment, for simplicity, the roller sliding amount is omitted.

Based on the print data, after the leading edge of the recording paper is pinched by the nip of the conveyance roller 36, the conveyance roller 36 conveys the recording paper to the print start position. Subsequently, the carriage 50 executes a scanning operation, and the recording head 7 executes a recording operation. Next, as the conveyance roller 36 and the discharge roller 40 execute the conveyance operation, the carriage 50 executes the scanning operation and the recording head 7 executes the recording operation continuously. The conveyance operation of each of the rollers is controlled based on the stored conveyance amount correction values SLF1 to SLF8 and SEJ1 to SEJ8 each corresponding to one of the roller phase sections.

During recording, when the recording apparatus causes the recording paper to travel a conveyance distance L determined by the length of a row of nozzles of the recording head or by the number of passes of the recording head required to complete each band image, the target conveyance distance L is corrected based on correction data. In this way, the recording apparatus can cause the recording paper to travel the distance L. For example, when both the conveyance roller 36 and the discharge roller 40 convey the recording paper between the phases ps1 and ps2, the correction value SLF1 is used to correct the target conveyance distance L. The correction value SLF1 is a correction value when the distance $\pi \cdot Dr/8$ is used as a target, and thus, the recording paper can travel the target conveyance distance L based on the following expression:

$$L+SLF1\times L/(\pi \cdot Dr/8)$$

When the phase section changes while the recording paper travels the distance L, the recording apparatus controls the conveyance as follows. For example, assuming that conveyance of the recording paper is started from the phase ps1 to ps2 and that after a conveyance distance L1 the recording paper is conveyed from the phase ps2 to ps3, since the conveyance start phase is managed, the conveyance distance L1 from the conveyance start phase to the phase 2ps can be calculated based on a correction value. Namely, assuming that the conveyance roller 36 is rotated by θ [radian] to reach the phase ps2, the conveyance distance L1 can be calculated as follows:

$$L1=Dr\cdot\theta-SLF1\times\theta/(\pi/8)$$

The remaining target conveyance distance L2 from the phase ps2 can be calculated by calculating the distance L−L1. Thus, the remaining target conveyance distance from the phase ps2 is corrected as follows:

$$L2+SLF2\times L2/(\pi \cdot Dr/8)$$

By using the target conveyance distance L2 to cause the recording paper to travel the remaining distance, the recording apparatus can cause the recording paper to travel the entire distance L.

As the recording apparatus executes the recording operation, when the trailing edge of the recording paper reaches the conveyance start phase to pass the conveyance roller 36, the recording apparatus conveys the recording paper $^{160}/_{1200}$ inches, which is defined as the conveyance amount for the transfer from the conveyance roller 36 to the discharge roller 40.

The conveyance start phase is fixed at the phase SPK (=ep5), and the recording apparatus causes the recording paper to travel the conveyance distance LSK. By obtaining information about the recording paper size and calculating the integrated values of the cumulative recording paper conveyance distances, a conveyance distance LSK1 that the recording paper travels until the trailing edge thereof passes the nip can be calculated. By using the distance SK5 that the recording paper travels by elimination of the warp in the discharge roller 40, the entire conveyance distance LSK can be calculated as follows:

$$LSK=LSK1+SKE+LSK2$$

Since LSK2 can also be calculated, the conveyance distance L2 can be executed by driving the conveyance roller 36 and the discharge roller 40 based on the target conveyance distance calculated as follows:

$$LSK+SLF5\times LSK/(\pi \cdot Dr/8)+LSK2+SEJ5\times LSK2/(\pi \cdot Dr/8)$$

When the conveyance distance correction value SKE for the roller transfer is calculated by the expression SKE=SK−LS, the expression LSK+SKE is used as the target conveyance distance to drive the conveyance roller 36 and the discharge roller 40.

While the above conveyance amount correction values are determined based on the correction value measurement test patterns at factory shipment, since the recording apparatus includes the scanner unit 60 as a distance measurement unit, the user can determine the correction values arbitrarily. For example, when any one of the rollers deteriorates with age and the image quality is decreased, the user can modify the conveyance amount correction values at any time. Further, the user may regularly modify the conveyance amount correction values, depending on the number of papers processed by the recording apparatus.

Thus, according to the present exemplary embodiment, regarding recording and conveyance at the transfer from the conveyance roller 36 to the discharge roller 40, when the test patterns are printed, the recording apparatus executes the transfer conveyance at a predetermined roller phase. In addition, transfer conveyance amounts are measured based on the test patterns. In this way, the conveyance amount correction values are determined. The recording apparatus uses conveyance amount correction values determined based on the predetermined roller phases identical to those used to obtain the test patterns to execute the transfer conveyance during a normal recording operation. In this way, reliability of the measured values obtained based on the correction value measurement test patterns is increased. Thus, appropriate correction values can be set, and highly accurate printing can be executed at the roller transfer with reduced variation. Since the recording apparatus does not require particular hardware units other than a roller phase detection unit, the recording apparatus can be manufactured at low cost.

In the first exemplary embodiment, the rollers are rotated per phase section, and the difference between measured and theoretical values in conveyance distance is calculated per phase section. The obtained values are used as the correction values. According to a second exemplary embodiment of the present invention, based on the measured conveyance distance values obtained from the portions S1 to S8 each being an interval between two of the test patterns, the conveyance distance of one pulse of an encoder signal is calculated, and the calculated value is stored as a correction value.

More specifically, for example, assuming that the recording paper is conveyed by an m1 pulse of an encoder single in the section S1, if the actual conveyance distance by the conveyance roller 36 and the discharge roller 40 is LLF1 and the actual conveyance distance by the discharge roller 40 alone is LEJ1, the conveyance distances ILF1 and IEJ1 of one pulse can be calculated based on the measured values LLF1 and LEJ1 as follows:

$$ILF1=LLF1/m1$$

$$IEJ1=LEJ1/m1$$

In this way, the recording apparatus calculates the conveyance distances ILF1 to ILF8 and IEJ1 to IEJ8 of one pulse in all the phase sections, and the storage unit stores the calculated values.

When the trailing edge of the recording paper passes the nip between the conveyance roller 36 and the pinch roller 37, the recording paper is conveyed by the conveyance by the conveyance roller 36 and the discharge roller 40, the conveyance by the discharge roller 40 alone, and the movement of the recording paper by elimination of the warp in the discharge roller 40. Assuming that the recording paper conveyance distance measured based on the test pattern SK portion is LSK, that the recording paper is conveyed by both the conveyance roller 36 and the discharge roller 40 based on m51 pulses of an encoder signal, and that the recording paper is conveyed by the discharge roller 40 based on m52 pulses, if the recording paper travels the distance SK5 by elimination of the warp in the discharge roller 40, the value SK can be calculated as follows:

$$SK=ILF5\times m51+IEJ5\times m52+SK5$$

Since the recording paper size and the roller conveyance start phase are known in advance and the conveyance distance in each phase section can be accurately calculated based on the correction values, the values m51 and m52 can also be calculated. Thus, the distance SK5 can also be calculated. This value SK is stored in the storage unit.

Next, control during conveyance will be described.

To cause the recording paper to travel a distance L per conveyance, it is necessary to drive the roller 36 based on L/ILF1 pulses from the phase ps1 to ps2. To cause the recording paper to travel by the discharge roller 40 alone, the roller 40 is driven based on L/IEJ1 pulses.

Further, when the phase section changes while the recording paper travels the distance L, since the conveyance start phase is managed, the pulse number until the phase section changes can be calculated. For example, assuming that the recording paper is conveyed between the phases ps2 and ps3 after being conveyed based on m11 pulses between the ps1 and ps2, between the phases ps1 and ps2, the recording paper travels the distance calculated as follows:

$$(ILF1)\times m11$$

To cause the recording paper to travel the total distance L after causing the recording paper to travel the remaining distance L−ILF1×m11 between the phases ps2 and ps3, after the phase changes, the recording paper is conveyed based on the pulses corresponding to the value calculated as follows:

$$(L-ILF1\times m1)/ILF2$$

Next, the conveyance distance L2 that the recording paper travels when the trailing edge thereof passes the nip between the conveyance roller 36 and the pinch roller 37 will be described. Assuming that the conveyance start phase of the conveyance roller 36 has already been adjusted so that the conveyance is executed between the phases ps5 and ps6 and that the trailing edge of the recording paper passes the nip when the recording paper is started to be conveyed based on m51 pulses, the value m51 can be calculated based on the recording paper size, the conveyance start phase of the conveyance roller 36, and the integrated values of the cumulative conveyance distances. Before the recording paper passes the nip, the recording paper travels the following distance by the conveyance roller 36 and the discharge roller 40:

$$ILF5\times m51$$

When passing the nip, the recording paper travels the distance SK5 by elimination of the warp in the discharge roller 40. To cause the recording paper to travel the total distance L2 after causing the recording paper to travel the remaining distance L2−ILF5×m51−SK5 by the discharge roller 40 alone, the discharge roller 40 alone is controlled to convey the recording paper based on the pulses corresponding to the value calculated as follows:

$$(L2-ILF5\times m51-SK5)/(IEJ5)$$

A third exemplary embodiment of the present invention includes a configuration for realizing roller transfer conveyance at an optimum phase point, in addition to the configuration of the first exemplary embodiment. Among the roller phase points that can be selected in roller transfer conveyance, there is an optimum point where conveyance behavior is stabilized at the point B, which is the nip portion of the conveyance roller. This point is strongly dependent on the relative difference in conveyance speed between the conveyance roller 36 and the discharge roller 40. Thus, in the present exemplary embodiment, the conveyance speed of the conveyance roller 36 and that of the discharge roller 40 are measured, and based on the measured values, the roller transfer rotation phase is determined.

Figure 20A:
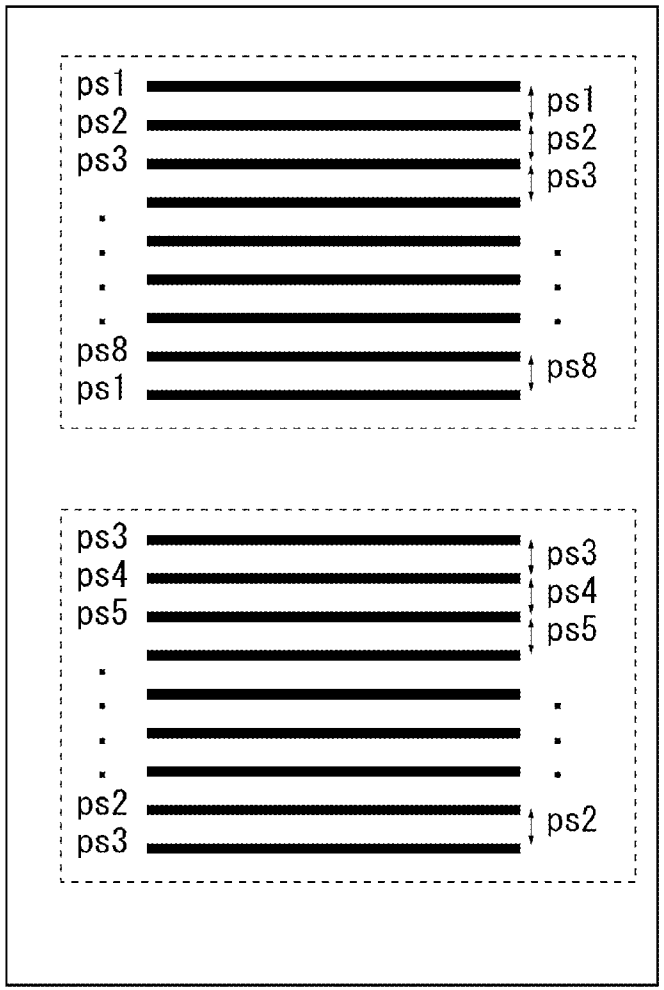
FIGS. 20A and 20B illustrate correction value measurement test patterns according to the third exemplary embodiment of the present invention.
Figure 20B:
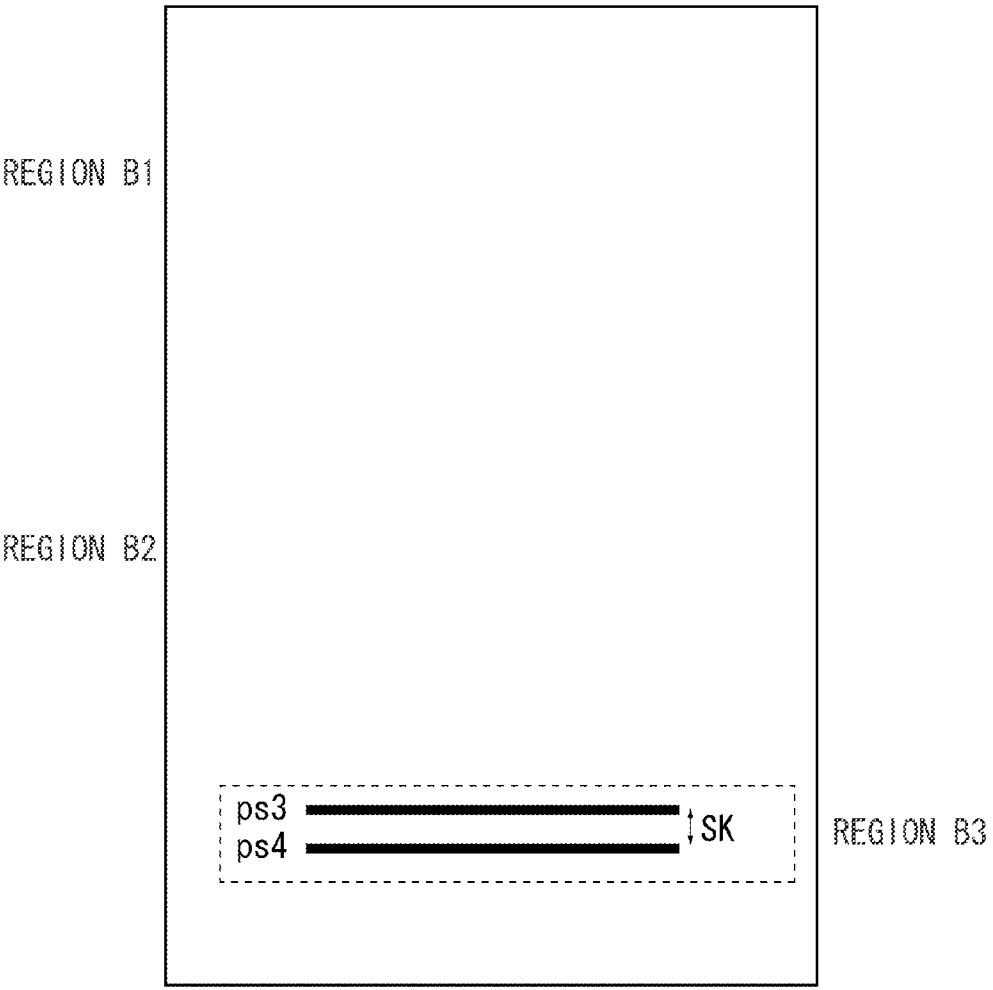

As illustrated in FIGS. 20A and 20B, correction value measurement test patterns according to the present exemplary embodiment are printed on two pages. The first page illustrated in FIG. 20A includes pattern regions B1 and B2 each including test patterns used for measuring a unit conveyance distance for each phase of the conveyance roller 36 and the discharge roller 40, respectively. The second page illustrated in FIG. 20B includes a pattern region B3 including test patterns used for measuring the conveyance distance at the transfer from the conveyance roller 36 to the discharge roller 40.

Figure 19:
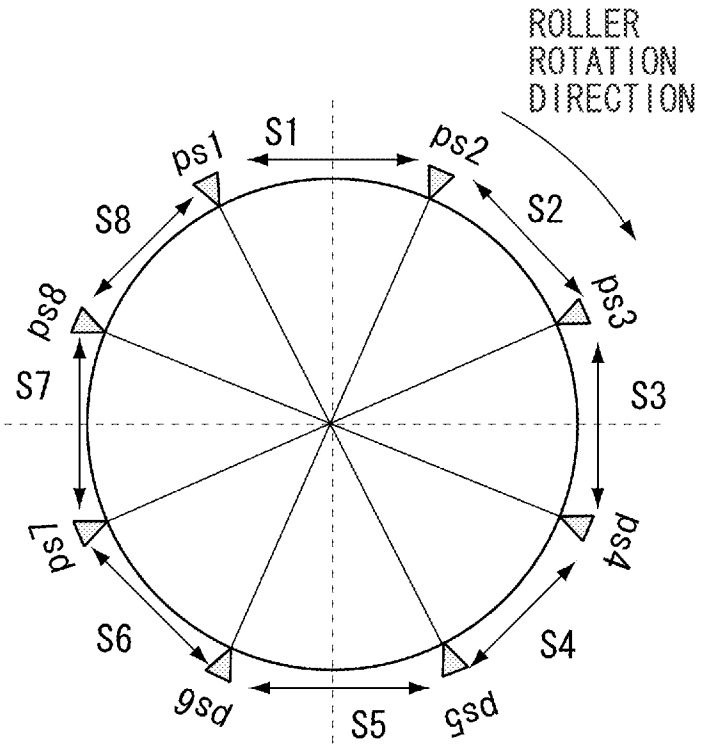
FIG. 19 illustrates a schematic correction configuration according to a third exemplary embodiment of the present invention.
Figure 21:
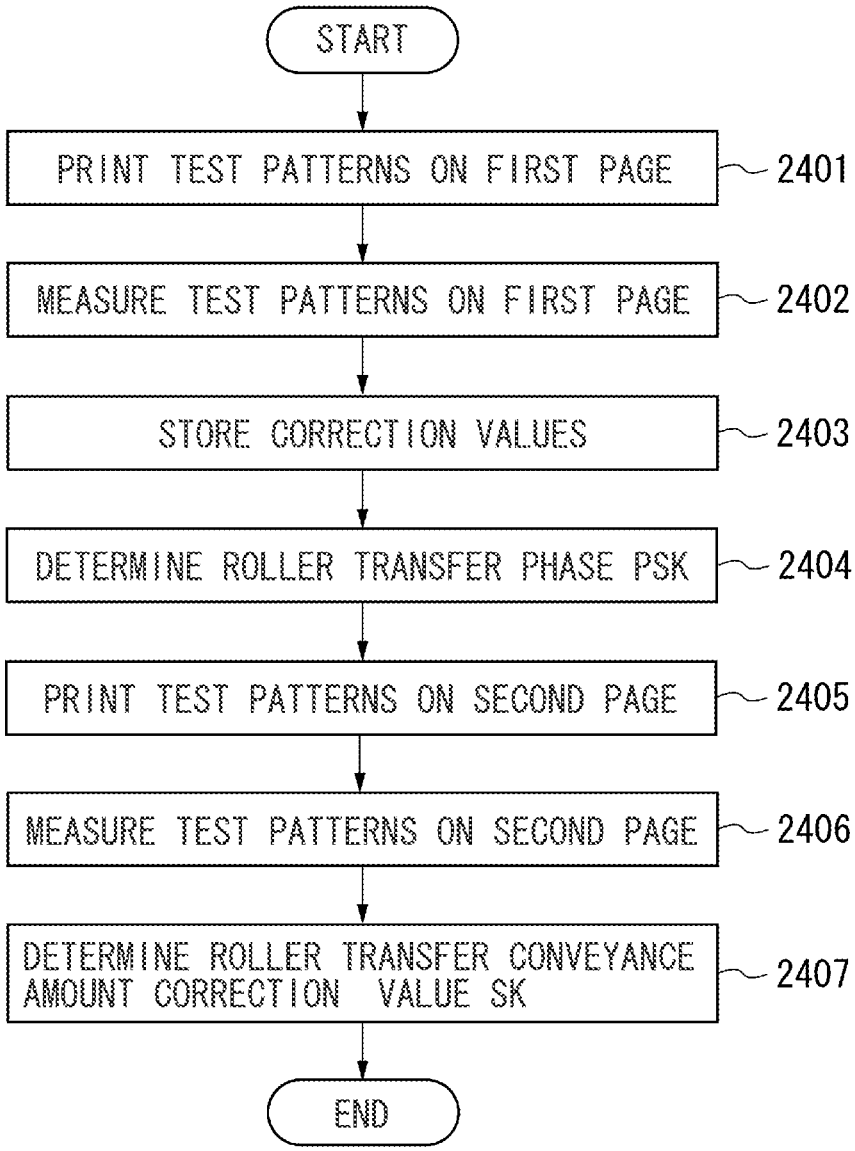
FIG. 21 is a control flow chart according to the third exemplary embodiment of the present invention.

FIG. 21 is a flow chart illustrating a specific conveyance distance correction value determination method. FIG. 19 illustrates a conceptual diagram of a roller and a table of correction values. In FIG. 19, the rotation phase of the roller is divided into eight sections for simplicity, and a correction value is set per roller phase section and is stored in the table. As in the first exemplary embodiment, since the rotation phase ratio between the conveyance roller 36 and the discharge roller 40 is the same, each of the phases of the rollers 36 and 40 is represented by a single angle in the correction value table.

First, as in the first exemplary embodiment, the recording apparatus executes the roller phase origin detection processing, so that the mechanical roller phase origin can be determined and the phase can be managed. Next, in step 2401, the recording apparatus prints test patterns on the first page, as illustrated in FIG. 20A. The test patterns on the first page are the rotation phase determination patterns for determining the rotation start phase at the roller transfer. The operations for printing the test patterns in the pattern regions B1 and B2 on the first page are the same as those according to the first exemplary embodiment. The recording apparatus can record a plurality of groups of conveyance distance measurement patterns in the pattern regions B1 and B2. More specifically, by rotating the conveyance roller 36 from the same phase as that used in the first exemplary embodiment based on a predetermined amount, the recording apparatus records the patterns in the region B1 for measuring the conveyance distance that the recording paper travels by both the conveyance roller 36 and the discharge roller 40. In addition, by rotating the discharge roller 40 alone, the recording apparatus records the patterns in the region B for measuring the conveyance distance that the recording paper travels by the discharge roller 40 alone. In FIG. 20A, the rotation start phase is different between the regions B1 and B2.

After printing the test patterns on the first page, in step 2402, the recording apparatus controls a distance measurement unit or the like of an image processing system to measure test pattern intervals S1 to S8. The recording apparatus controls the scanner unit 60 therein as the distance measurement unit.

Next, in step 2403, the recording apparatus stores the correction values in the conveyance distance correction value storage locations each prepared for a roller phase. More specifically, each of the measured values is subtracted from a corresponding one of the theoretical roller conveyance distance values, and the calculated values are determined to be the conveyance distance correction values. These values are stored in SLF1 to SLF8 and SEJ1 to SEJ8 of the correction value table of FIG. 19.

Next, for each roller phase, the absolute value ΔSn (ΔS1 to Δ58) of the difference between the conveyance distance correction value of the conveyance roller 36 and that of the discharge roller 40 is defined. The absolute value ΔSn (n=1 to 8) can be calculated as follows:

$$\Delta Sn=|(SLFn-SEJn)|$$

In step 2404, among the calculated values ΔS1 to Δ58, a roller phase corresponding to the smallest value is set to be the roller transfer phase PSK at the transfer from the conveyance roller 36 to the discharge roller 40. The description will hereinafter be made based on an assumption that, at the roller phase S3, the absolute value of the difference between the conveyance distance correction value of the conveyance roller 36 and that of the discharge roller 40 is the smallest. Thus, the phase S3 is set to be the roller transfer phase PSK.

Alternatively, since the following equations are met, $$SLFn=\pi\cdot Dr/8-LLFn$$

$$SEJn=\pi\cdot Dr/8-LEJn$$

the value ΔSn can be calculated as follows:

$$\Delta Sn=|(LLFn-LEJn)|$$

Thus, by measuring the conveyance distance that the recording paper travels by both the conveyance roller 36 and the discharge roller 40 and the conveyance distance that the recording paper travels by the discharge roller 40 alone for each phase and obtaining the smallest difference in conveyance distance, a roller phase corresponding to the smallest difference may be determined to be the roller transfer phase PSK.

Next, in step 2405, the recording apparatus prints the test patterns on the second page as illustrated in FIG. 20B. When printing the test patterns on the second page, the recording apparatus sets the roller transfer phase from the conveyance roller 36 to the discharge roller 40 to be the roller transfer phase PSK set based on the test patterns on the first page. Regarding this printing of the test patterns, the roller transfer phase is set to be the roller transfer phase PSK based on the method as described in the first exemplary embodiment.

First, as in the first exemplary embodiment, the recording apparatus executes the roller phase origin detection processing, so that the mechanical roller phase origin can be determined and the phase can be managed. Next, the recording apparatus drives the conveyance roller 36 to reach the standby stop phase calculated based on the roller transfer phase PSK (first rotation phase). Next, the recording apparatus executes a paper feed operation and causes the conveyance roller 36 to nip the recording paper, so that the first conveyance of the recording medium by the conveyance roller 36 starts at a second rotation phase. Next, to record the patterns in the region B3, the recording apparatus causes the rollers 36 and 40 to convey the recording paper until the trailing edge of the recording paper reaches a certain point a predetermined distance short of the nip between the conveyance roller 36 and the pinch roller 37. When the trailing edge reaches the certain point, the recording apparatus stops the rollers. More specifically, after a paper edge sensor detects the trailing edge of the recording paper, when the trailing edge reaches the certain point the predetermined distance short of the nip between the conveyance roller 36 and the pinch roller 37, the recording apparatus stops the conveyance roller 36 and the discharge roller 40. According to the present exemplary embodiment, the recording apparatus stops the conveyance roller 36 and the discharge roller 40, so that the trailing edge of the recording paper is positioned $^{64}/_{1200}$ inches short of the nip between the conveyance roller 36 and the pinch roller 37.

The recording apparatus stops the conveyance roller 36 and the discharge roller 40 at a phase psk1 and controls the recording head 7 to print the first row of the test patterns. Next, the recording apparatus causes the recording paper to travel $^{160}/_{1200}$ inches defined as the roller transfer conveyance distance according to the present exemplary embodiment. Based on this conveyance operation, after the trailing edge of the recording paper on which the test patterns have been printed is released from the conveyance roller 36, the recording paper is conveyed by the discharge roller 40 alone. After stopping the discharge roller 40, the recording apparatus controls the recording head 7 to print the second row of the test patterns. Based on these operations, for the transfer from the conveyance roller 36 to the discharge roller 40, the recording apparatus causes the recording paper to travel a predetermined distance at the roller transfer phase PSK, and the actual recording paper conveyance distance can be represented as the interval between the patterns.

After the printing of the test patterns, in step 2406, the recording apparatus controls a distance measurement unit or the like in an image processing system to measure the interval SK between the test patterns. The recording apparatus controls the scanner unit 60 therein as the distance measurement unit. Next, in step 2407, the measured value is subtracted from the theoretical roller conveyance distance value and the obtained value is determined to be the conveyance distance correction value. The recording apparatus stores the correction value in the conveyance distance correction value storage location SK in the correction value table prepared for the roller transfer conveyance.

Thus, by executing the operations as described above, the conveyance distance correction values and the roller transfer phase for the transfer from the conveyance roller 36 to the discharge roller 40 can be determined. Additionally, based on the correction values, a third rotation phase, which is the conveyance end phase of the roller transfer, can be determined. The absolute value of the difference in average conveyance speed between the conveyance roller 36 and the discharge roller 40 in a rotation phase range from the first to third rotation phases is smaller than the absolute value of the difference in average conveyance speed between the conveyance roller 36 and the discharge roller 40 in a range other than the above rotation phase range.

As described above, the recording apparatus sets a roller phase at which the difference between the conveyance speed of the conveyance roller 36 and that of the discharge roller 40 is the smallest or not present. If the roller bearing portion is arranged symmetrically with respect to the center of the width of the recording paper, the center of the recording paper matches the center of the roller. Thus, it is preferable that the conveyance speed of the conveyance roller 36 is controlled to be the same as that of the discharge roller 40. However, the optimum point differs depending on configurations such as the roller length and roller conveyance settings. Thus, according to the present invention, the selected roller phase is not limited to the roller phase at which the conveyance speed of the conveyance roller 36 is equal to that of the discharge roller 40.

As described with FIGS. 11A to 11C in the first exemplary embodiment, the conveyance distance at the transfer from the conveyance roller 36 to the discharge roller 40 is the sum of the conveyance distance of the conveyance section A by the conveyance roller 36, the conveyance distance of the conveyance section C by the discharge roller 40, and by the movement distance of the discharge roller 40 by elimination of the warp in the discharge roller 40 caused by the traction force between the discharge roller 40 and the recording paper. Thus, by selecting the phase at which the absolute value of the difference between the conveyance distance correction value of the conveyance roller 36 and that of the discharge roller 40 is zero, theoretically, even if the recording paper passes the nip of the conveyance roller 36, no movement by elimination of the warp in the discharge roller 40 is caused. Namely, since the conveyance distance correction values of the conveyance roller 36 and the discharge roller 40 per roller phase are determined based on the test patterns on the first page, the conveyance distance correction value at the roller transfer can be determined only by the sum of the conveyance distance correction value of the conveyance section A by the conveyance roller 36 and the conveyance distance correction value of the conveyance section C by the discharge roller 40.

However, the conveyance speed of an actual recording apparatus varies not only by eccentricity or roundness misalignment of the conveyance roller 36 and the discharge roller 40 but also by errors of other components. Examples of such errors include the eccentricity of the conveyance roller encoder sensor 363, the conveyance code wheel 362, the discharge roller encoder 403, and the discharge code wheel 402 used to detect the rotation angle of each of the rollers. Namely, the conveyance distances measured based on the test patterns on the first page are not sheer conveyance distances by each of the rollers. Thus, even if a phase at which the absolute value of the difference between the conveyance distance correction value of the conveyance roller 36 and that of the discharge roller 40 is zero is selected, the conveyance speed of the conveyance roller 36 and that of the discharge roller 40 may not become equal.

Figure 22:
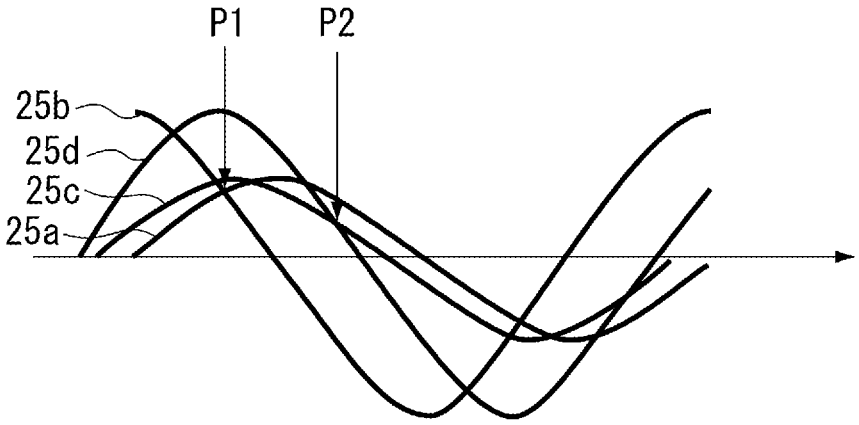
FIG. 22 illustrates measurement error factors according to the third exemplary embodiment of the present invention.

FIG. 22 schematically illustrates such errors. More specifically, FIG. 22 illustrates apparent conveyance speeds 25*a* and 25*b* of the rollers, and the conveyance speeds 25*a* and 25*b* can be measured based on the test patterns. A roller transfer phase P1 is determined based on these measured conveyance speeds. However, if disturbance is removed, the sheer conveyance speeds of the rollers are indicated by waves 25*c* and 25*d*. Thus, an optimum roller transfer phase P2 is determined based on these actual conveyance speeds. However, the traction force (frictional force) between the discharge roller 40 and the recording paper is caused, which is not estimated based on the test patterns, and accordingly, the discharge roller 40 is moved by elimination of the warp in the discharge roller 40. This movement causes a conveyance distance error at the roller transfer that cannot be measured based on the test patterns on the first page alone. This conveyance distance error is increased with the number of disturbance factors. For example, if the discharge roller encoder 403 and the discharge code wheel 402 are eliminated for cost reduction, even component errors, such as eccentricity of a gear train of the pulley gear 361, the idler gear 45, and the discharge roller gear 404, are added to the measured conveyance distance by the discharge roller 40.

To compensate these conveyance distance errors, the conveyance distance at the roller transfer needs to be measured based on the test patterns on the second page as illustrated in FIG. 20B.

The recording apparatus and the conveyance amount control method using the recording apparatus according to the above exemplary embodiment have thus been described. The recording apparatus includes a conveyance unit conveying a recording paper, a recording unit recording an image on the recording paper. The conveyance unit includes a first conveyance unit located upstream of the recording unit in a conveyance direction and a second conveyance unit located downstream in the conveyance direction. In addition, the recording apparatus includes a correction pattern recording operation in which a conveyance amount correction value is determined. The correction value is used for the transfer of the recording paper from the first conveyance unit to the second conveyance unit. When executing the correction pattern recording operation, the recording apparatus acquires information about the transfer rotation phase and conveyance amount of the conveyance unit. When forming an image, based on the information, the recording apparatus determines the transfer rotation phase and conveyance amount of the conveyance unit.

In addition, the recording paper can be transferred at a point where the speed increasing ratio between this main controller and the discharge roller does not fluctuate greatly, and reliability of the measured values based on the correction value measurement test patterns can be increased.

In addition, other than the roller phase origin detection unit, since no other particular mechanisms are required for eccentricity correction, higher-quality printing can be executed at low cost.

According to each of the above exemplary embodiments, regarding the conveyance of a recording paper, more specifically, regarding when the recording paper is completely transferred from the conveyance roller to the discharge roller, the conveyance distance at the transfer is measured based on test patterns to determine a conveyance distance correction value. Based on the test patterns on the first page, the conveyance speed of each of the rollers per phase is calculated to determine an optimum roller phase to transfer the recording paper from the conveyance roller 36 to the discharge roller 40. Based on the test patterns on the second page, the transfer conveyance distance is measured to determine the conveyance distance correction value.

In addition, in a normal recording operation, the recording apparatus executes the transfer conveyance based on the roller transfer phase and the conveyance distance correction value determined by the test patterns. In this way, since reliability of the measured values based on the correction value measurement test patterns is improved, appropriate correction values can be set. Thus, the recording apparatus can accurately execute the roller transfer with reduced variation in speed difference between the conveyance roller 36 and the discharge roller 40. Therefore, the image forming apparatus can execute printing accurately. In addition, other than a roller phase detection unit, since no particular hardware configuration is required, the present invention can be realized at low cost.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-030454 filed Feb. 15, 2010, which is hereby incorporated by reference herein in its entirety.

What is claimed is:

1. A correction information determination method for controlling a recording apparatus including a first conveyance unit configured to convey a recording medium in a conveyance direction, a recording unit arranged downstream of the first conveyance unit in the conveyance direction and configured to record an image on the recording medium, and a second conveyance unit arranged downstream of the recording unit in the conveyance direction and configured to rotate in synchronization with the first conveyance unit and to convey the recording medium, the correction information determination method comprising:

via the recording apparatus, causing the first conveyance unit to rotate by a predetermined amount and recording patterns for measuring a conveyance distance when a conveyance state is changed from a state in which both the first and second conveyance units convey the recording medium to a state in which the second conveyance unit conveys the recording medium after a trailing edge of the recording medium passes the first conveyance unit and the first conveyance unit releases the recording medium;

acquiring a conveyance start rotation phase of the first conveyance unit, the conveyance start rotation phase used when the conveyance state is changed by causing the first conveyance unit to rotate by the predetermined amount, to determine a conveyance start rotation phase of the first conveyance unit, the conveyance start rotation phase used when the conveyance state is changed during recording by the recording apparatus; and determining, based on the conveyance distance measured based on the recording patterns, correction information about a rotation amount of the first conveyance unit, the rotation amount used when the conveyance state is changed during recording by the recording apparatus.

2. The correction information determination method according to claim 1, further comprising recording rotation phase determination patterns for determining in advance a conveyance start rotation phase of the first conveyance unit, the conveyance start rotation phase used when the conveyance state is changed.

3. The correction information determination method according to claim 2, wherein the rotation phase determination patterns include patterns for measuring conveyance distances that the recoding medium travels by both the first and second conveyance units when the first conveyance unit is caused to rotate by a predetermined amount from a plurality of rotation phases and patterns for measuring conveyance distances that the recording medium travels by the second conveyance unit after the first conveyance unit releases the recording medium, and wherein the rotation phase determination patterns are used to determine, for each roller phase, the absolute value of the difference between the conveyance distance that the recording paper travels by both the first and second conveyance units and the conveyance distance that the recording paper travels by the second conveyance unit after the first conveyance unit releases the recording paper and to determine a rotation phase corresponding to the smallest absolute value.

4. The correction information determination method according to claim 3, wherein the absolute value of the difference between the conveyance distances is zero.

5. The correction information determination method according to claim 1, wherein the rotation ratio between the first and second conveyance units is 1:1.

6. The correction information determination method according to claim 5, wherein the rotation ratio of a unit transmitting driving force to the first and second conveyance units to the first and second conveyance units is 1:1.

7. The correction information determination method according to claim 1, wherein the recording apparatus further includes an image reading unit configured to read an image of a document, and wherein the correction information determination method further comprises causing the image reading unit to read the recording patterns and measure conveyance distances.

8. A rotation start phase determination method for controlling a recording apparatus including a first conveyance unit configured to convey a recording medium in a conveyance direction, a recording unit arranged downstream of the first conveyance unit in the conveyance direction and configured to record an image on the recording medium, and a second conveyance unit arranged downstream of the recording unit in the conveyance direction and configured to rotate in synchronization with the first conveyance unit and to convey the recording medium, the rotation start phase determination method comprising:

via the recording apparatus, recording a plurality of groups of patterns by changing a rotation start phase, the patterns including patterns for measuring conveyance distances that the recording medium travels by both the first and second conveyance units by causing the first conveyance unit to rotate by a predetermined amount from a predetermined rotation phase and patterns for measuring conveyance distances that the recording medium travels by the second conveyance unit after the first conveyance unit releases the recording medium by causing the first conveyance unit to rotate by a predetermined amount from the same rotation phase; and determining, based on the conveyance distances acquired from the patterns, for each roller phase, an absolute value of difference between the conveyance distance that the recording paper travels by both the first and second conveyance units and the conveyance distance that the recording paper travels by the second conveyance unit after the first conveyance unit releases the recording paper and determining a rotation phase corresponding to the smallest absolute value to be a rotation start phase.

9. A recording apparatus configured to adjust a rotation phase of a first conveyance unit when the first conveyance unit starts initial conveyance of a recording medium, so that rotation of the first conveyance unit is started from a rotation start phase determined by the rotation start phase determination method according to claim 8 and the conveyance state is changed from a state in which the first conveyance unit and a second conveyance unit convey the recording medium to a state in which the second conveyance unit conveys the recording medium after the trailing edge of the recording medium passes the first conveyance unit and the first conveyance unit releases the recording medium and configured to cause the recording unit to execute recording on the recording medium.

10. A recording apparatus comprising:

a first conveyance unit arranged upstream of a recording unit in a conveyance direction and configured to convey a recording medium;

a second conveyance unit arranged downstream of the recording unit in the conveyance direction and configured to convey the recording medium;

an acquisition unit configured to acquire information about a conveyance distance error caused by movement of the recording medium caused when a trailing edge of the recording medium passes the first conveyance unit and when a warp that has been present in the second conveyance unit in a state in which both the first and second conveyance units convey the recording medium is eliminated; and a control unit configured to control the first and second conveyance units by correcting, based on the information about the error, a conveyance distance error caused by movement of the recording medium when the trailing edge of the recording medium passes the first conveyance unit and when a warp that has been in present in the second conveyance unit is eliminated.

11. The recording apparatus according to claim 10, further comprising:

a drive unit configured to drive the first and second conveyance units in synchronization with each other; and a phase detection unit configured to detect a phase of at least one of the first and second conveyance units, wherein the control unit adjusts the phase of the first conveyance unit at the start of conveyance of the recording medium, so that the trailing edge of the recording medium passes the first conveyance unit when the phase detected by the phase detection unit is within a predetermined range.

12. A recording medium conveyance method in a recording apparatus including a recording unit configured to record an image on a recording medium, a first conveyance roller arranged upstream of the recording unit in a conveyance direction and configured to convey a recording medium, a pinch roller configured to convey the recording medium with the first conveyance roller by pinching the recording medium therebetween and a second conveyance roller arranged downstream of the recording unit in the conveyance direction, the recording medium conveyance method comprising:

performing a first measurement of measuring a conveyance amount of a sheet at a time when a trailing edge of the sheet passes a nip portion formed by the first conveyance roller and the pinch roller;

conveying, using the nip portion, the recording medium in a manner such that, when the recording unit performs recording on the recording medium, a phase of the first conveyance roller at a time when a trailing edge of the recording medium passes through the nip portion is the same as a phase of the first conveyance roller at a time when the first measurement is performed; and correcting the conveyance amount of the first conveyance roller at the time when the trailing edge of the recording medium passes the nip portion, based on a result of the first measurement.

13. The recording medium conveyance method according to claim 12, wherein conveying includes determining a phase of the first conveyance roller at a time when the nip portion starts the conveyance of the recording medium, based on length information of the recording medium.

14. The recording medium conveyance method according to claim 12, wherein when the first conveyance roller goes into a 360-degree roll, the second conveyance roller goes into a 360-degree roll.

15. The recording medium conveyance method according to claim 14, wherein the recording apparatus comprises a conveyance motor configured to drive the first conveyance roller, and wherein the second conveyance roller is driven by the conveyance motor.

16. The recording medium conveyance method according to claim 15, further comprising:

performing a second measurement of measuring, in association with a phase of the first conveyance roller, a conveyance amount of the sheet at a time when the sheet is conveyed by the nip portion and the second conveyance roller; and performing a third measurement of measuring, in association with the phase of the first conveyance roller, a conveyance amount of the sheet at a time when the sheet is conveyed only by the second conveyance roller.

17. The recording medium conveyance method according to claim 16, wherein conveying includes determining the phase of the first conveyance roller at the time when the first measurement is performed, based on a result of the second measurement and a result of the third measurement.

18. The recording medium conveyance method according to claim 17, wherein conveying includes determining a phase of the first conveyance roller at a time when the nip portion starts the conveyance of the recording medium, based on length information of the recording medium.

* * * * *